US008482506B2

(12) United States Patent
Kwok et al.

(10) Patent No.: US 8,482,506 B2
(45) Date of Patent: Jul. 9, 2013

(54) TRANSIENT LIQUID CRYSTAL ARCHITECTURE

(75) Inventors: Hoi Sing Kwok, Hong Kong (CN); Yuet Wing Li, Hong Kong (CN)

(73) Assignee: The Hong Kong University of Science and Technology, Kowloon (HK)

( * ) Notice: Subject to any disclaimer, the term of this patent is extended or adjusted under 35 U.S.C. 154(b) by 1554 days.

(21) Appl. No.: 11/967,947

(22) Filed: Dec. 31, 2007

(65) Prior Publication Data

US 2008/0218469 A1 Sep. 11, 2008

Related U.S. Application Data

(60) Provisional application No. 60/897,256, filed on Jan. 25, 2007.

(51) Int. Cl.
*G09G 3/38* (2006.01)

(52) U.S. Cl.
USPC ..... 345/102

(58) Field of Classification Search
USPC ..... 345/87, 100, 102
See application file for complete search history.

(56) References Cited

U.S. PATENT DOCUMENTS

2005/0174340 A1* 8/2005 Jones ..... 345/204

OTHER PUBLICATIONS

Towler, Mike J. et al., "LN-14: A 1 Millisecond Response Time, Nematic LCD", Eurodisplay 2002, p. 877-880.

McKee, S.P. et al., "38.1: Invited Paper: Combining Stereopsis and Motion in Human Vision", SID Symposium Digest of Technical Papers, May 1998, vol. 29, Issue 1, pp. 1029-1032.

Li, Yuet-Wing, et al., "Passive Matrix Driven Field Sequential Color Displays", SID '07, May 22-27, 2007.

Ihara, S., et al, "13.5: A Color STN-LCD with Improved Contrast, Uniformity, and Response Times", SID Int. Symp. Digest of technical papers, pp. 232-235, 1992.

Yamakawa, Masaki et a., "Development of a Field Sequential Color View Finger for Color Video Cameras", IEEE Transactions on Consumer Electronics, vol. 39, No. 3, Aug. 1993.

Xu, M., et al., "11.4L: Late-News Paper: Very High Pretilt Alignment and its Application in Pi-Cell LCDs", SID Symposium Digest of Technical Papers—May 1998—vol. 29, Issue 1, pp. 139-142.

Jamal, Syed H., et al., "Accurate Modeling of the Dynamics of TN Devices with Flow", SID 98 Digest XXIX, 985-988 (1998).

Watson, P. et al., "Optimization of Bend Cells for Field-Sequential Color Microdisplay Applications", SID 1999.

P.J. Bos et al, "The pi-Cell: A Fast Liquid-Crystal Optical-Switching Device", Mol. Cryst. Liq. Cryst., 1984, vol. 113, p. 329.

(Continued)

*Primary Examiner* — Yong H Sim
(74) *Attorney, Agent, or Firm* — Turocy & Watson, LLP

(57) ABSTRACT

Methods and systems for displaying videos with high contrast using fast transient response of liquid crystal materials are disclosed. The system comprises a liquid crystal material treated with a chiral dopant, which is aligned between two substrates with conductive layer on each substrate. The system can be operated in an active or passive matrix mode display. The active matrix display can be a thin film transistor (TFT) or MOS transistor, whereas no transistors are used for the passive matrix mode display. A full color display, with high contrast, can be achieved by illuminating the transient liquid crystal material with a pulsed backlight.

26 Claims, 17 Drawing Sheets

OTHER PUBLICATIONS

M. Xu, et al., "11.4L: Late-News Paper: Very High Pretilt Alignment and Its Application in Pi-Cell LCDs", SID Digest, 10, 2901, (1998).

F.S. Yeung, et al., "Pi-Cell Liquid Crystal Displays at Arbitrary Pretilt Angles", Applied Physics Letters 88, 041108 (2006).

F.S. Yeung, et al, "Variable Liquid Crystal Pretilt Angles by Nanostructured Surfaces", Applied Physics Letters 88, 051910 (2006).

Berreman, "Liquid-crystal Twist Cell Dynamics with Backflow", Journal of applied Physics, vol. 46, No. 9, Sep. 1975, p. 3746 -3751.

C.Z. van Doorn, "Dynamic Behavior of Twisted Nematic Liquid-Cyrstal Layers in Switched Fields", Journal of Applied Physics, vol. 46, No. 9, Sep. 1975, p. 3738-3745.

Tiezheng Qian, et al, "Generalized Hydrodynamic Equations for Nematic Liquid Crystals", Phys. Rev. E, vol. 58, No. 6, pp. 7475-7485.

Pochi Yeh, "Etended Jones Matrix Method", Journal Optical Society of America, vol. 72, No. 4, Apr. 1982, p. 507-513.

A. Lien, "Extended Jones Matrix Representation for the Twisted Nematic Lliquid-Cyrstal Display at Oblique Incidence", Appl. Phys. Lett. 57 (26), Dec. 24, 1990, p. 2767-2769.

Shu-Hsia Chen, et al., "Flow Effect in the Chiral-Homeotripic Liquid-Crystal Cell", Applied Physics Letters, vol. 75, No. 22, Nov. 29, 1999, p. 3491-3493.

* cited by examiner

TRANSIENT LIQUID CRYSTAL ARCHITECTURE

CROSS-REFERENCE TO OTHER APPLICATION

Priority is claimed from U.S. Provisional patent application 60/897,256, which is hereby incorporated by reference filed on Jan. 25, 2007, entitled "Fast Liquid Crystal Display Mode" by Hoi-Sing Kwok and Yuet-Wing Li.

BACKGROUND

The present application relates to liquid crystal display (LCD) technology.

The points discussed below may reflect the hindsight gained from the disclosed innovations, and are not necessarily admitted to be prior art.

Many applications require optically fast switching liquid crystal displays. One significant application is the elimination of motion blur in LCD television. The other is the use of field sequential color (FSC) to achieve full color display without the use of color filters.

There are several fast time switching LCD configurations, and one is the bend cell or pi-cell. It fulfills the most essential requirement of short switching time and good viewing angle (see P. J. Bos and K. R. Koehler/Beran, Mol. Cryst. Liq. Cryst., 113 (1984), p. 329). However, this bend mode is not stable under zero voltage bias, because the elastic energy of splay is always less than the bend mode under the same boundary conditions.

M. Xu et al., taught a method to stabilize the bend mode under zero bias using a very high pretilt angle (see M. Xu, D. K. Yang, P. J. Bos, *SID Digest,* 10, 2901 (1998)). A method to obtain different pretilt angle (0° to 90°) using a nano-texture alignment surface was introduced by Fion F. S. Yeung et al (see F. S. Y. Yeung, Y. W. Li and H. S. Kwok, *Appl. Phys. Lett.,* 88, 041108 (2006)). In this method, polyamides for vertical and horizontal alignment are physically mixed to form sufficiently small domains on the alignment surface due to liquid-liquid phase separations. The pretilt angles are changeable according to different surface area ratio (See F. S. Y. Yeung, J. Y. Ho, Y. W. Li, F. C. Xie, O. Tsui, P. Sheng and H. S. Kwok, *Appl. Phys. Lett.,* 88, 051910 (2006)). With high pretilt angles, the bend mode can be stable at zero voltage bias. This kind of stabilized bend mode is named "No-Bias Bend" mode. However, further efforts must be done in order to ensure the uniformity and robustness of the alignment surface.

Another method for fast switching LCD is the vertically aligned nematic LCD. The vertical alignment can provide excellent contrast (>1000:1). A high contrast is an important factor for performance of field sequential LCD. A high contrast ratio induces good color saturation and purity for color mixing. Otherwise, color leakage will affect the color reproduction. By using low velocity rotational viscosity liquid crystal (LC), and decreasing the cell-gap to about <2 μm, the switching time of the device can be as fast as 2 ms. However, such small cell-gaps are not favorable, and not feasible from manufacturing standpoint.

Prior art embodiments require the LCD to switch from one state to another within a very short time. For example, suppose the LCD alignment is in a certain steady state configuration at voltage $V_1$ and another steady state configuration at voltage $V_2$. It is then required that LC molecules change their alignment from one configuration to another quickly when the voltage is changed from $V_1$ to $V_2$. However, this is a stringent requirement that is not necessary if the backlight is a pulsed light such as a light emitting diode (LED). Presently, in most LCD applications, the frame rates are very fast. For example, in a 120 frame per second display, the frame time $T_f$ is only 8 ms. In the case of field sequential color displays, the frame times are even shorter.

The present inventors have realized that it is an overkill to require the LC molecules to change their alignment within such a short time and stay in that configuration. To overcome the problems posed in the prior art, the present innovations use the transient response in conjunction with the pulsed backlight.

Previous approaches have been based on equilibrium effects. The LC is required to be stable under certain applied voltages. The optical response time is determined by the transit time between two different static steady states.

One particular transient effect is the optical bounce (see S H Chen et al., *Flow effect in the chiral nematic liquid crystal cell, Journal of Applied Physics*, vol 75, p 3491, 1999). The optical bounce is usually undesirable in LCD applications, but for this innovation, it is emphasized and enhanced. Note that optical bounce is only one of many possible transient effects. All of these effects are useful for the present innovations for producing a fast LCD.

In the present innovations, the transient effect of LC is used to produce a fast LCD response. Since the subframe time of the field sequential display is typically very short, the transient response is as good as the steady state response.

The grayscale is obtained by averaging the transmittance of the subframe. Using this dynamic approach, the true steady state-to-steady state response time of the LC can be ignored. The transient response time, in conjunction with the pulsed backlight is used, and it is found that the transient state can provide good transmittance and sufficient brightness for the display.

In these innovations, a special configuration of LC is used to maximize the brightness of the transient effect. Particularly, the cell-gap up to 5 μm can be used. Additionally, such configuration can be applied to drive the field sequential display using the passive matrix and the active matrix modes.

SUMMARY

Methods and systems for reducing smear and power consumption in liquid crystal units are introduced. An LC device is driven to generate a fast transient state in the LC material. A backlight is pulsed to illuminate the liquid crystal material during a particular time period in the fast transient state to achieve a desired optical transmission of the backlight through the LC material.

In a preferred embodiment, display can be achieved by illuminating the liquid crystal material in its fast transient response state with a pulsed backlight.

In another embodiment, the present innovations can be operated in an active matrix display mode, wherein the display can be a thin film transistor or a mass transistor.

In another embodiment, the present innovations can be operated in a passive matrix mode, wherein no transistors are used.

In another embodiment, the pulsed backlight can be white light or a timed sequence of red, green, and blue light.

In another embodiment, the liquid crystal layer is treated with a chiral dopant having an opposite twist sense as the alignment-induced twist.

In another embodiment, a dark frame can be inserted between every data frame. In this embodiment using a white backlight, the dark frame data can include the entire color display. The data frame can be a separate red, green, and blue subframe when a red, green, and blue timed light sequence is used as the backlight.

In another embodiment, the fast transient response state is the twist-splay state of LC material.

In another embodiment, the fast transient response state is the optical bounce in response of an active matrix display mode.

In another embodiment, the fast transient response state is the decay in the response of a passive matrix display mode.

The benefits of the present innovations can include:

Improved brightness of a display.

A high contrast with a minimal amount of cross-talk.

Reduced blurring.

Low power consumption.

A full color display without the use of color filters.

BRIEF DESCRIPTION OF THE DRAWINGS

The disclosed inventions will be described with reference to the accompanying drawings, which show important sample embodiments of the invention and which are incorporated in the specification hereof by reference, wherein:

FIG. 1(*b*) shows a transreflective cross-sectional view of LCD.

FIG. 1(*c*) shows a reflective cross-sectional view of LCD.

DETAILED DESCRIPTION OF SAMPLE EMBODIMENTS

The numerous innovative teachings of the present application will be described with particular reference to presently preferred embodiments (by way of example, and not of limitation).

Figure 1A:
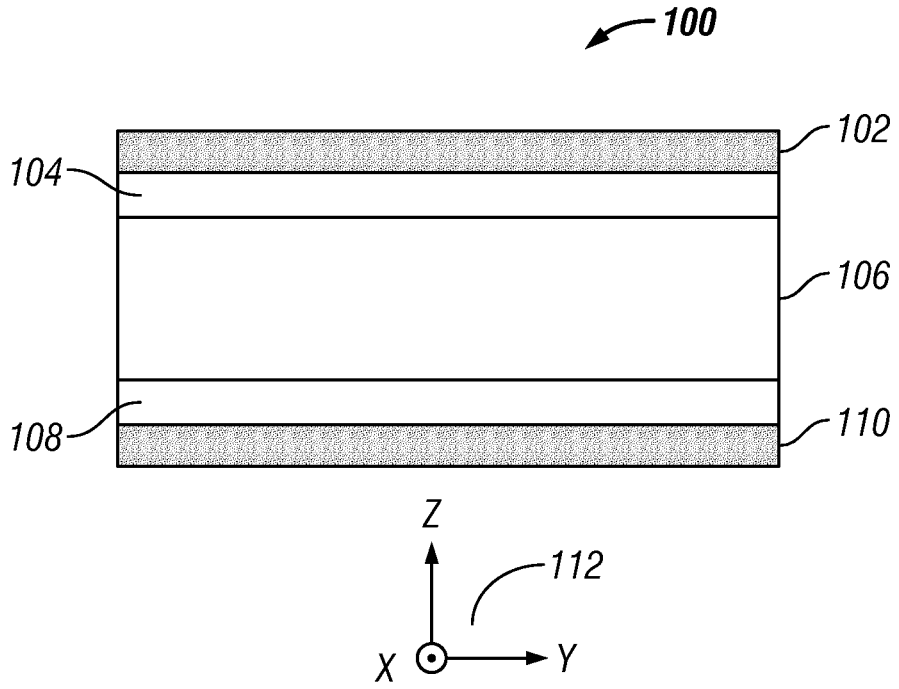
FIG. 1(*a*) schematically shows a transmissive cross-sectional view of LCD.
Figure 1B:
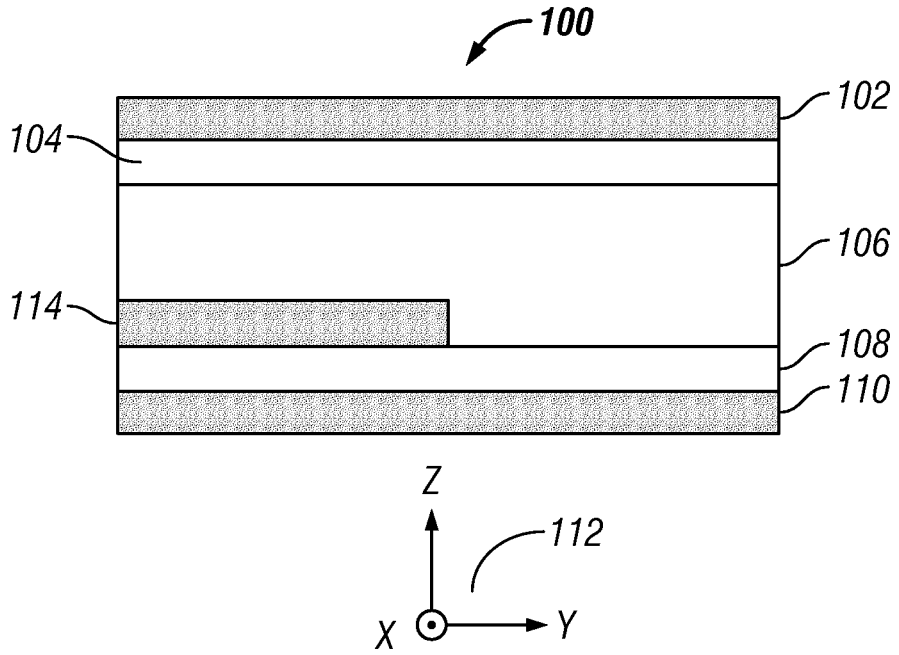
Figure 1C:
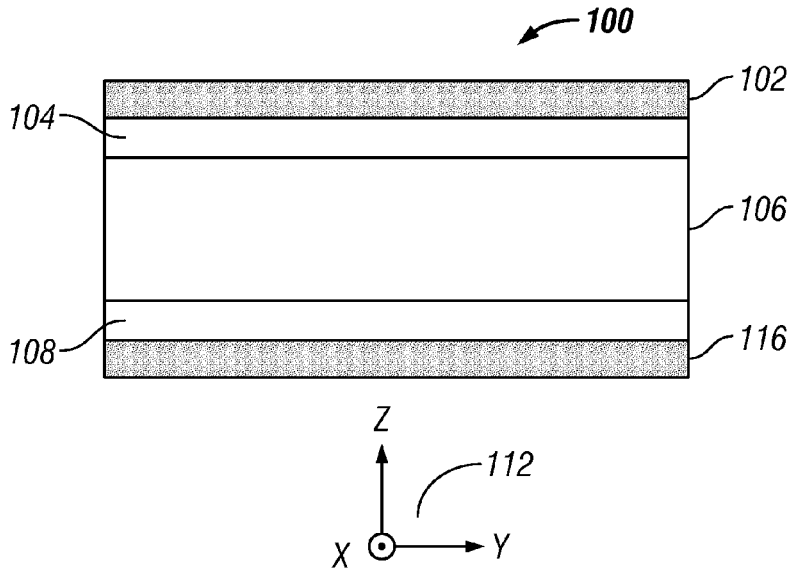

FIG. 1 (*a*) schematically shows the transreflective cross-sectional view of an LCD. The LCD 100 comprises a transmissive display that includes a front polarizer 102, a rear polarizer 110, and a liquid crystal layer 106 held between two glass substrates 104 and 108 respectively. Axes 112 represent a coordinate system for the liquid crystal display assembly. The substrates 104 and 108 can have conductive transparent electrodes such as Indium Tin Oxide (ITO) for providing voltages to pixels for the passive matrix display. The voltage control can also be provided by thin film transistors on glass in an active matrix mode arrangement. Alignment layers and other coatings necessary for making the display can also be provided on the substrates.

FIG. 1(*b*) shows a slightly modified transreflective cross-sectional view of an LCD 100 incorporating a diffusive reflector 114 added to the LCD assembly. Otherwise, the transreflective LCDs 100 in FIGS. 1(*a*) and 1(*b*) are identical in construction.

FIG. 1(*c*) shows the reflective cross-sectional view of another embodiment of the LCD 100. For a single polarizer reflective display, the rear polarizer 110 is eliminated, and a special reflector 116, which does not produce any depolarization effect, is added. Otherwise, the transreflective LCDs 100 in FIGS. 1(*a*) and 1(*c*) are identical in construction.

Figure 2:
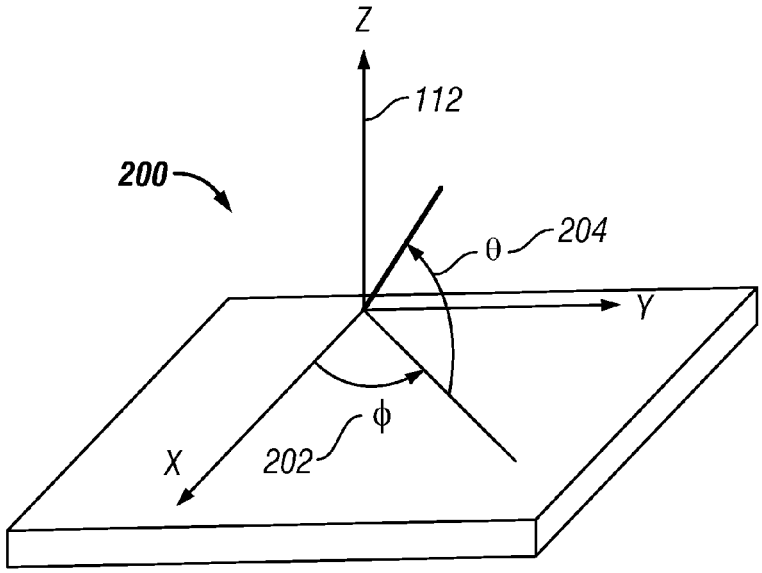
FIG. 2 shows the coordinate view of LCD.

FIG. 2 shows a layout of more detail of the coordinate system used in a LCD cell 200. The coordinate system 112 for LC is depicted with various directions inside an LC cell. The twist angle $\phi$ 202 is the angle between input and the output directors. The pretilt angles $\theta$ 204 ($\theta_1$ and $\theta_2$) are the angles between the tilted LC molecules and the alignment surfaces. The transmission or reflection properties of an LCD are completely characterized by its input polarizer angle $\alpha$, the cell-gap d, birefringence $\Delta n$, the output polarizer angle $\gamma$, and the twist angle of LC $\phi$ 202. The angles are measured relative to the input director of LCD cell 200, which is defined as the x-axis. The twist angle $\phi$ 202 is the angle between the input and output directors. The pretilt angles 204 ($\theta_1$ and $\theta_2$) are the angles between the tilted LC molecules and the alignment surfaces.

Figure 3:
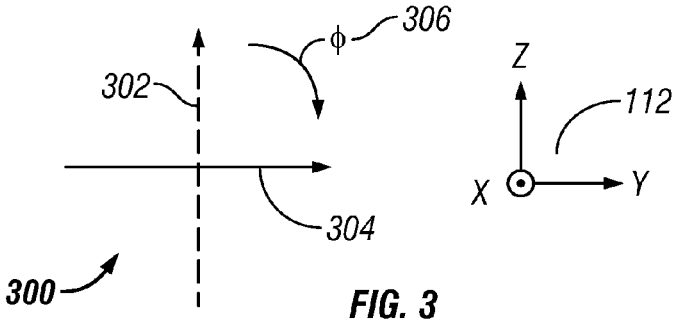
FIG. 3 shows the liquid crystal twist direction, and alignment direction of upper and lower substrates.

FIG. 3 shows the relationship between the rubbing or alignment directions and twist direction of the LC display 300. In a preferred embodiment of the present innovations, the rubbing direction 302 of the rear substrate is shown in accordance with the coordinate system 112, similar to as shown in FIG. 100(*a*). The alignment layer on the top substrate is aligned in direction 304. According to this alignment direction, the twist direction 306 should be in anti-clockwise direction to minimize the splay deformation. However, LC layer is intentionally doped with a chiral dopant to give it a reverse twist sense, and in this example, in the clockwise direction twice. The deformation of LC cell under zero voltage bias will be a clockwise twist with an angle determined by the doping concentration and a splay deformation. The pitch P of the LCD is defined as the distance when the twist angle of LC is 360°. The d/P ratio is an important design parameter of the LCD. For the present innovations, the absolute value of the d/P ratio is in the range of between about 0.01 to 0.5. This LCD mode is called the stressed splay twist (SST) mode.

The present innovations use transient dynamic response of LC layer to provide the contrast of the display. This is contrary to conventional techniques where one has to achieve a final deformation state of LC by decreasing the LC response time. The transient response is usually much faster than the steady state response time.

An example of the present innovations is the optical bounce phenomenon in nematic LCD when the voltage across LC cell is suddenly changed. Such phenomenon is caused by the backflow effect. (See, D. W. Berreman, "Liquid-crystal twist cell dynamics with backflow," *J. Appl. Phys.* 70, 3746-3751 (1975)) and (See, C. Z. Van Doom, "Dynamic behavior of twisted nematic liquid-crystal layers in switched fields," *J. Appl. Phys.* 46, 3738-3745 (1975)). This shear flow greatly affects the optical response time. This phenomenon can be modeled by the Ericksen-Leslie (EL) hydrodynamic equations. Since LC is in nematic order, no bulk displacement occurs. Therefore, the inertia of the liquid crystal can be ignored. The EL equation can be explicitly expressed in equations [1]-[3] as follows:

$$\sigma'_{ji} = \alpha_1 n_j n_i n_\mu n_\nu A_{\mu\nu} + \alpha_4 A_{ji} + \alpha_5 n_j n_\mu A_{\mu i} + \alpha_6 n_i n_\mu A_{\mu j} + \alpha_2 n_j N_i + \alpha_3 n_i N_j \quad [1]$$

$$h_i = -\frac{\partial F_d}{\partial n_i} + \partial_k \frac{\partial F_d}{\partial(\partial_k n_i)} - \frac{\partial F_E}{\partial n_i} \quad [2]$$

$$h'_i = -\frac{\partial F_d}{\partial n_i} + \partial_k \frac{\partial F_d}{\partial(\partial_k n_i)} - \frac{\partial F_E}{\partial n_i} \quad [3]$$

Where i and j denote the x, y, z components. $\sigma_{ij}'$ is the viscous stress tensor, n is the unit vector of LC director, $\alpha_i$ are six viscosity coefficients $A_{ij}=(\partial_i \upsilon_j+\partial_j \upsilon_i)/2$, $N=\dot{n}-\omega\times n$ with $\omega=\nabla\times v/2$ and $\dot{n}=\partial_t n+v\cdot\nabla n$. $\gamma_1$ and $\gamma_2$ are the viscosity coefficients. $\gamma_1=\alpha_3-\alpha_2$ and $\gamma_2=\alpha_2+\alpha_3=\alpha_6+\alpha_5$. $F_d$ and $F_E$ are the elastic free energy density and electric field induced free energy density respectively, as described by equations [4] and [5]:

$$F_d = \frac{1}{2}K_{11}(\nabla\cdot n)^2 + \frac{1}{2}K_{22}(n\cdot\nabla\times n - q_o)^2 + \frac{1}{2}K_{33}(n\times\nabla\times n)^2 \quad [4]$$

$$F_E = -\frac{1}{8\pi}E\cdot D \quad [5]$$

Where $K_{11}$, $K_{22}$ and $K_{33}$ are splay, twist and bend elastic constant, and $q_o$ is the natural pitch.

The detailed derivation of the equation can be found in standard textbooks on LC physics (see Ian W. Stewart, "The Static and Dynamic Continuum Theory of Liquid Crystals—A Mathematical Introduction," Taylor & Francis, 2004). By solving these equations, the director of liquid crystal n, according to time evolution can be obtained. T. Qian and P. Sheng taught a method to solve the equation by making the partial differential equations spatially discrete, and solving it by iteration (See T. Qian and P. Sheng, "Generalized hydrodynamic equations for nematic liquid crystal," *Phys. Rev. E* 58, 7475-7485 (1998)). After obtaining the time varying LC director distribution, the transmission can be calculated by the ordinary Jones matrix methods (see Yeh P., Extended Jones matrix method. *J Opt Soc Am A,* 1983, 72 and Lien A. "Extended Jones matrix representation for the twisted nematic liquid-crystal display at oblique incidence" *Appl Phys Lett,* 1990, 57).

Generally, when the voltage across LC molecules is changed, the alignment of the LC molecules changes with an optical bounce. This optical bounce is more evident when the alignment of the LC goes from the homeotropic state to the twist state. The amplitude of the optical bounce is governed by several parameters, such as liquid crystal viscosity, cell-gap, twist angle, chiral dopant concentration, elastic constants and the driving voltage. Viscosity is an intrinsic parameter of liquid crystal while other parameters can be externally controlled in accordance with LC configuration inside the LC bulk.

Since LCD is under constant elastic stress, its steady state alignment is a splay-twist deformation. Thus, the LC cell is called a stressed splay-twist (SST) cell, because there is splay stress in this cell. The splay stress is dependent on the pretilt angles ($\theta_1$ and $\theta_2$). For comparison, an ordinary Natural mode (TN) cell does not have this elastic deformation. When a high voltage pulse is applied, the bend-twist or a near homeotropic state is achieved. When the voltage is removed, elastic energy is released leading to a significant optical bounce.

Figure 4:
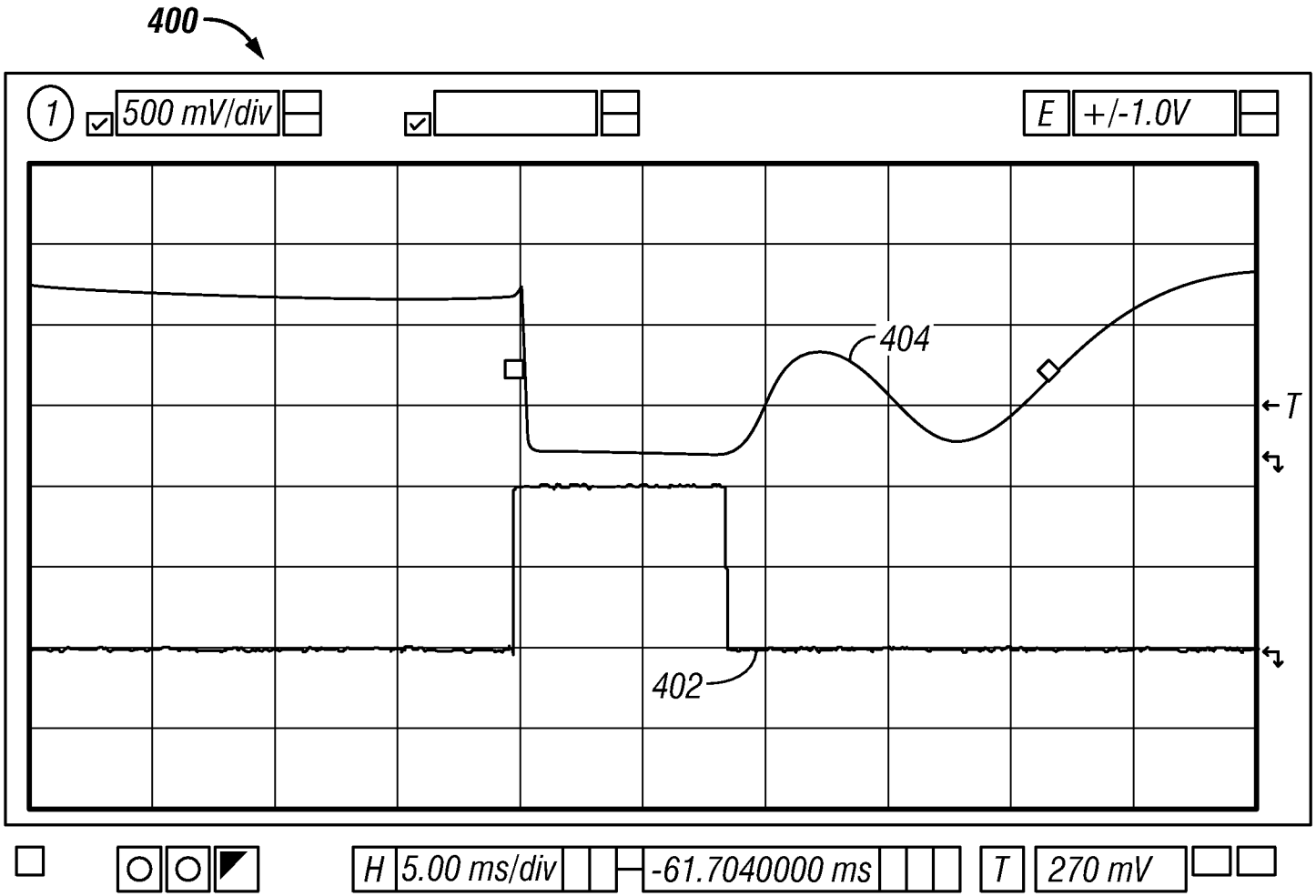
FIG. 4 shows an example of the backflow effect of reverse and normal twist nematic displays.

FIG. 4 shows a graph 400 of the backflow effect of the reverse and normal twist nematic displays. In FIG. 4, the lower trace 402 is the driving electrical pulse, and the upper trace 404 is the optical transmittance of LC cell. It can be observed that when the voltage is on, the transmission is zero, which represents the near homeotropic state of LC alignment. When the voltage is turned off, the transmittance of LC cell recovers immediately to the splay-twist state. It bounces one or two times before reaching to equilibrium. The optical bounce can be controlled by varying parameters such as the d/P ratio, the twist angle of the LC, and the cell gap. It is an elastic relaxation effect. By adjusting the parameters, it is possible to achieve a peak transmittance of over 90% in first optical bounce, with the peak of the transient transmission occurring in 2 ms. Thus, if the pulsed backlight is turned on during that time, an acceptable brightness display can be achieved with fast frame rate or short frame time $T_f$.

Figure 5:
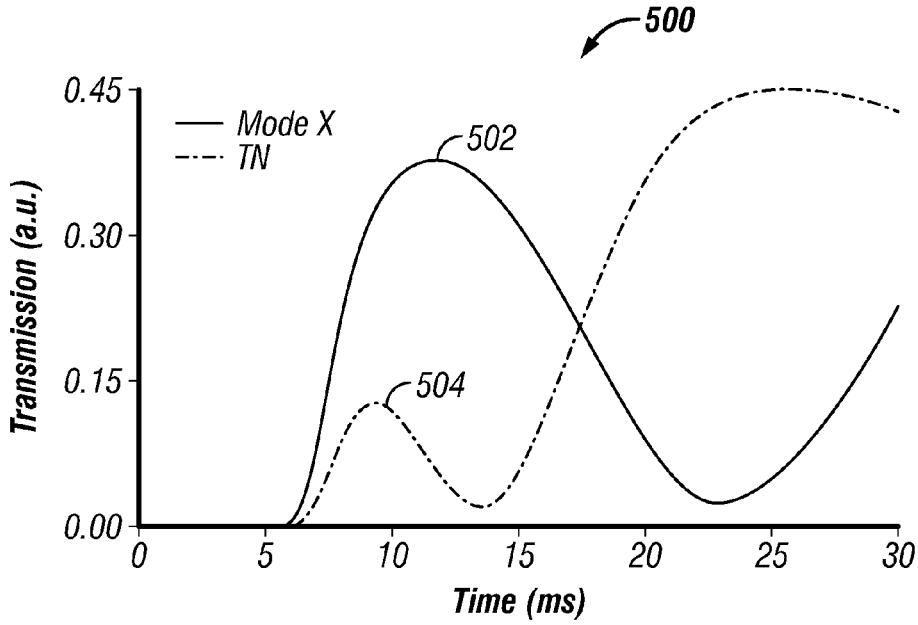
FIG. 5 shows a comparison of the backflow effect of TN mode and new LCD mode.

FIG. 5 shows a comparison of the backflow effect on TN and the present innovations LCD modes. This effect is shown in graph 500. It compares the optical bounce of an ordinary TN cell, and SST cell. It shows an important difference of the transient behavior of SST mode 502, and the TN mode 504 after the driving voltage is removed. It can be seen that SST mode has larger and faster optical bounce. Generally, this optical bounce is undesirable for display applications. However, in the present innovations, the pulsed light source is turned on only for a short time. For example, a good transmittance of the LC cell can be achieved in a short time, short frame time, and at fast frame rate, which is needed for the field sequential color. Thus, the dynamic behavior of the optical bounce can actually be beneficial for fast response applications. This is a preferred embodiment of the present innovations.

Figure 6:
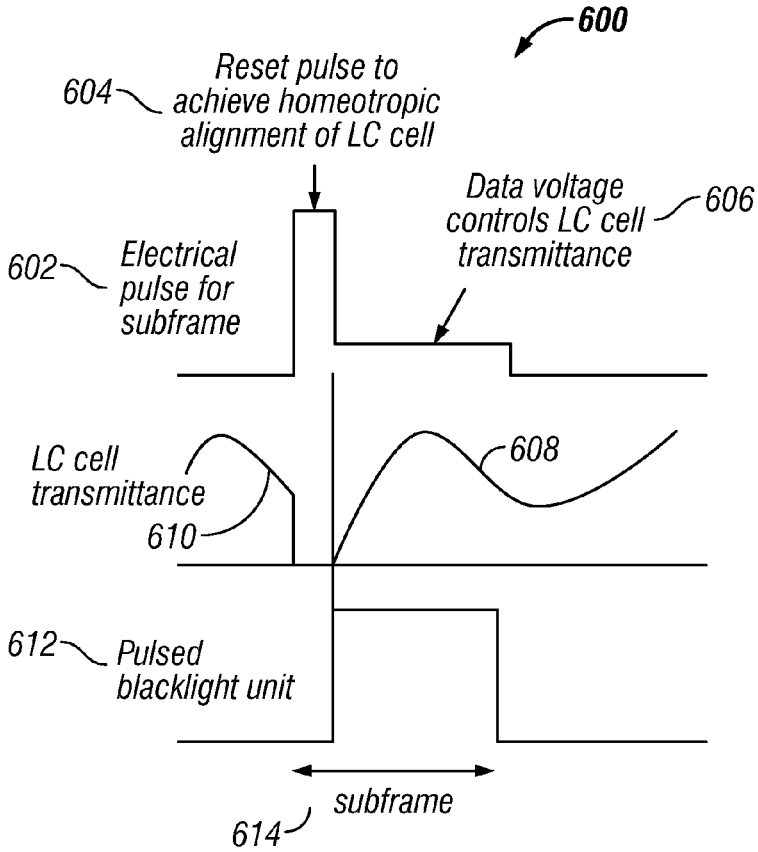
FIG. 6 shows a transient effect induced by the pulse.

FIG. 6 shows a schematic 600, wherein electrical pulse 602 on LC pixel is used to achieve various gray levels. First, a high voltage reset pulse 604 is applied, which turns LC into a near homeotropic state. After that a data pulse 606 is applied. This data pulse is a constant voltage level between reset pulses representing the different frames. The fast response optical bounce can be used to achieve different gray levels by adjusting the voltage of data pulse 604. The curve 608 represents a transient effect induced by the pulse 604. The LC cell transmittance output 610, in conjunction with the pulsed backlight 612, and subframe 614 is shown as the transient effect 608 induced by the pulse 604.

Figure 7:
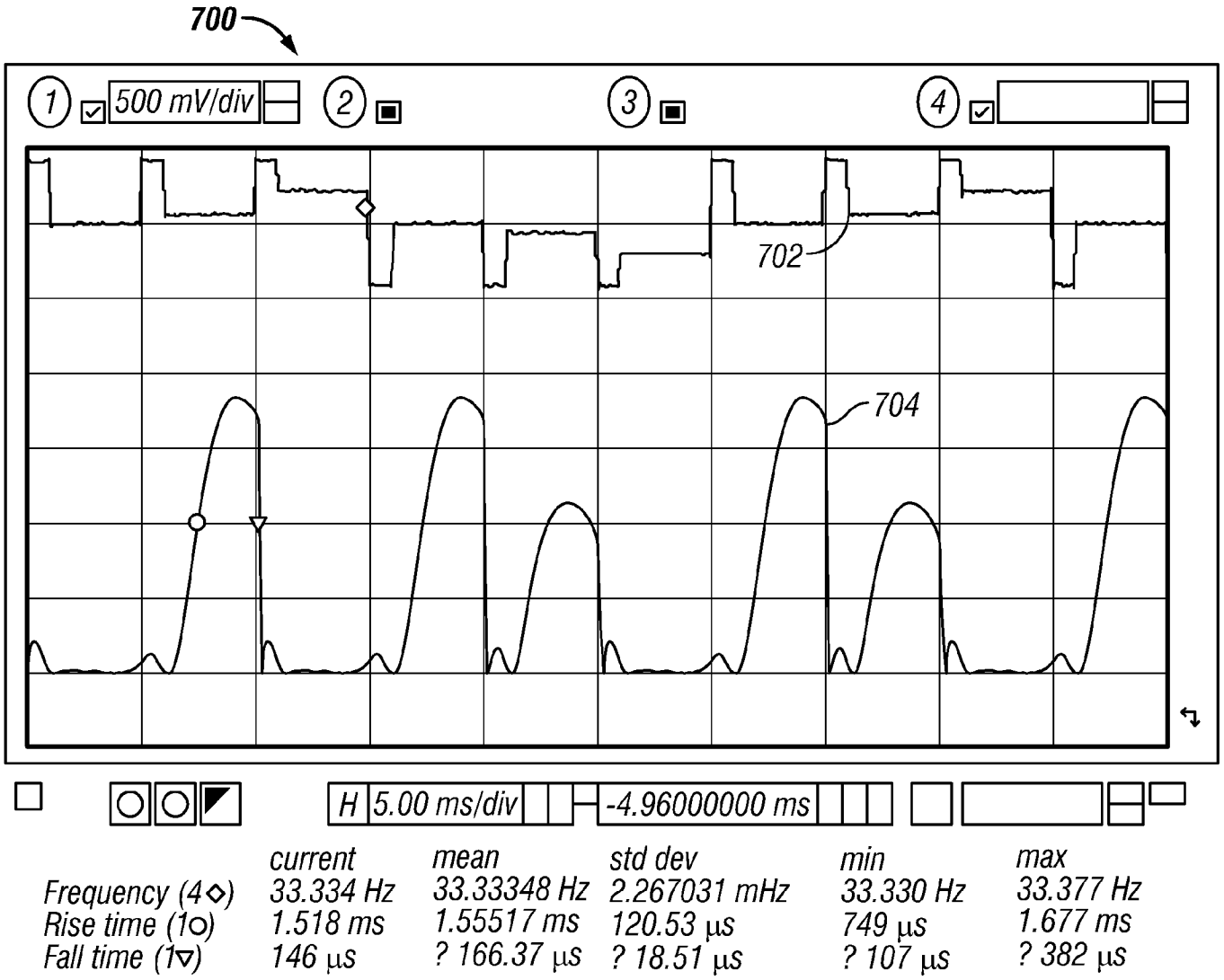
FIG. 7 shows a difference in grayscale by using different data frame voltages.

FIG. 7 shows a difference in grayscale by using different data frame voltages, more specifically; the transmittance of an actual construction of the present innovation is illustrated in graph 700. It shows a series of three different data voltage levels. The top trace or curve 702 is the electrical pulse across the pixel, and the lower trace or cure 704 is the optical transmittance. It can be seen that different data pulse voltage levels can induce a different transmittance. As shown in the lower curve in FIG. 7, each curve has a slightly different data voltage and a different transmittance. The data pulse can control the magnitude of the optical bounce, and the gray levels can be obtained precisely. This result can be used to drive the fast LCD.

Figure 8:
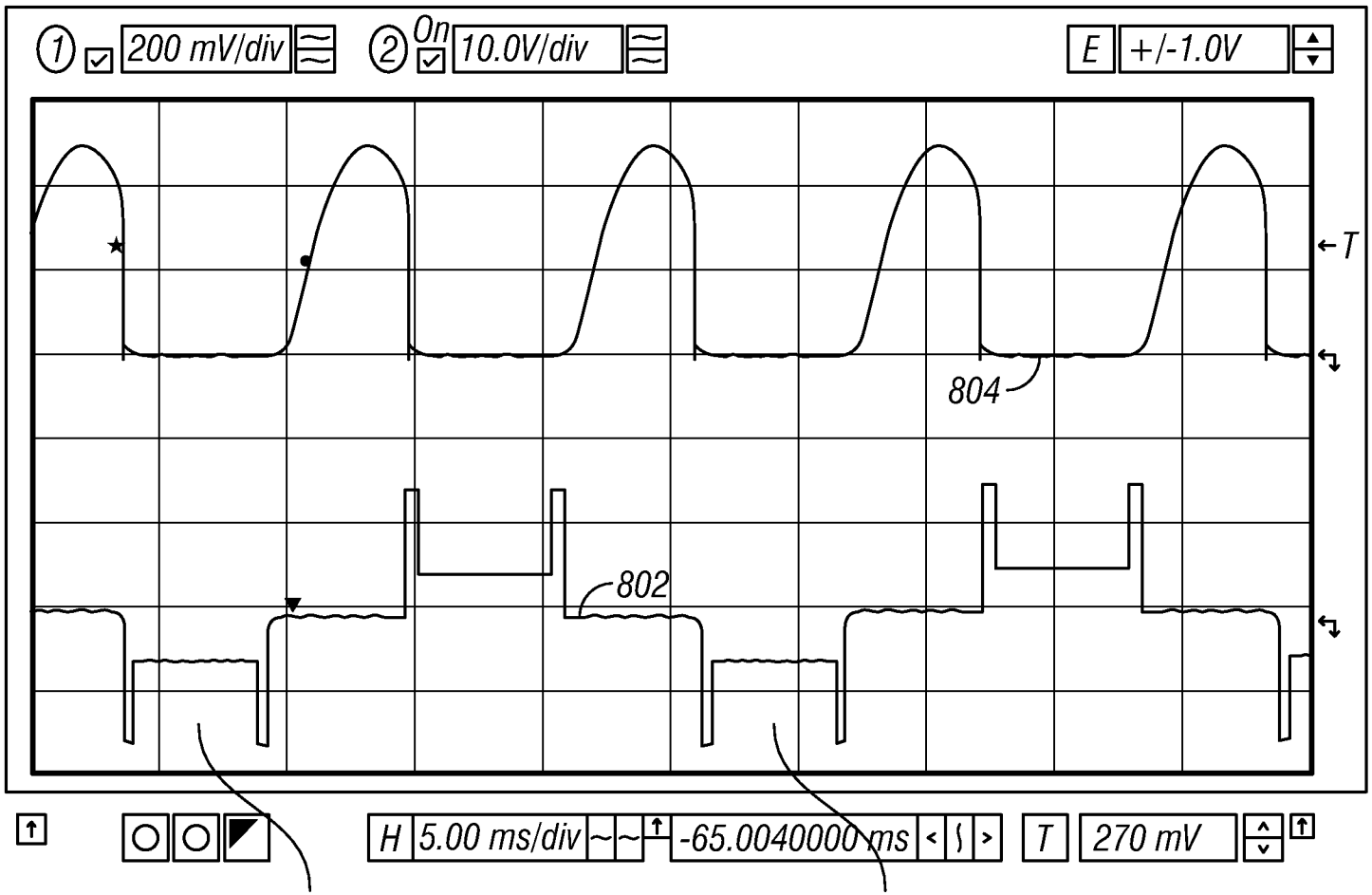
FIG. 8 shows the driving waveform and optical response of new LCD mode using an oscilloscope.

FIG. 8 shows an example of the electrical pulse, (lower trace 802) and the optical transmission of the LCD, (upper trace 804) for an alternating bright and dark state. The bright state corresponds to a low data voltage, and the dark state corresponds to a higher data voltage.

TABLE I

An example of LCD cell parameters for the first preferred embodiment.

| | |
|---|---|
| Twist angle | 90 degree right-handed twist |
| Doping | 90 degree left-handed twist |
| Cell gap | 5 microns |
| d/P ratio | 0.2 |
| Input polarizer | Parallel to input director (rubbing direction) of first substrate |
| Output polarizer | 90 degrees to the input polarizer |

Figure 9:
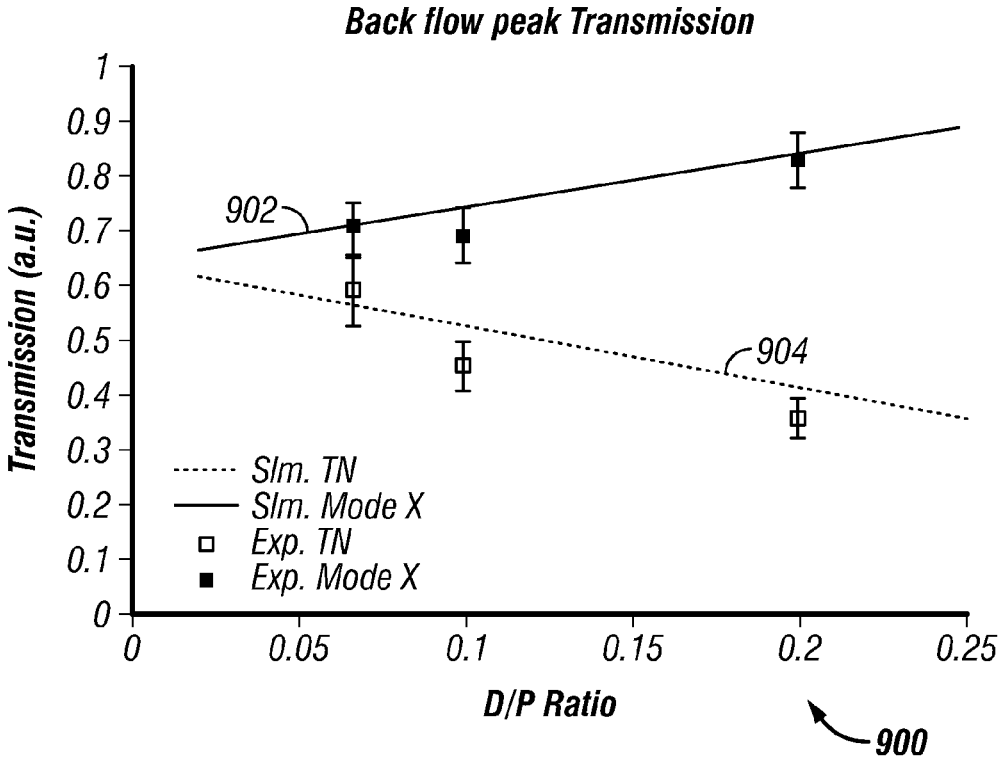
FIG. 9 shows a transmission versus voltage curve and the corresponding contrast.

Construction parameters for a specific example of this embodiment are shown in Table I. The LCD is in the normally bright state. Details of the experimental LC cell are shown in FIGS. 6, 7 and 9. The liquid crystal utilized, as an exemplary embodiment, is a MLC-6080 from Merck, with $n_e$=1.71, $n_o$=1.5076, $K_{11}$=14.4 pN, $K_{22}$=7.1 pN, $K_{33}$=19.1 pN is used. Both liquid crystal displays have the same d/P ratio of 0.2 and a thickness of 5 μm. However, since the twist direction is different, the transient behavior and dynamics of the two is totally different, and the slope of bounce is much steeper. It can be seen that the transient times for $V_{10}$ to $V_{90}$ are less than 1.5 ms. As shown in FIG. 5, the SST mode has a larger optical bounce, and a higher transient transmission then a TN cell.

FIG. 9 shows the effect of transmission versus d/P ratio. The graph 900 shows that a higher d/P ratio will increase the transmission of SST mode 902. However, the TN mode behaves in an opposite manner. Its maximum transmission is found at an infinite pitch 904. Additionally, the maximum transmission of TN is the same with the minimum transmission of SST mode. Therefore, it can be determined that SST mode has a higher transmission than TN mode under any d/P ratio.

Figure 10:
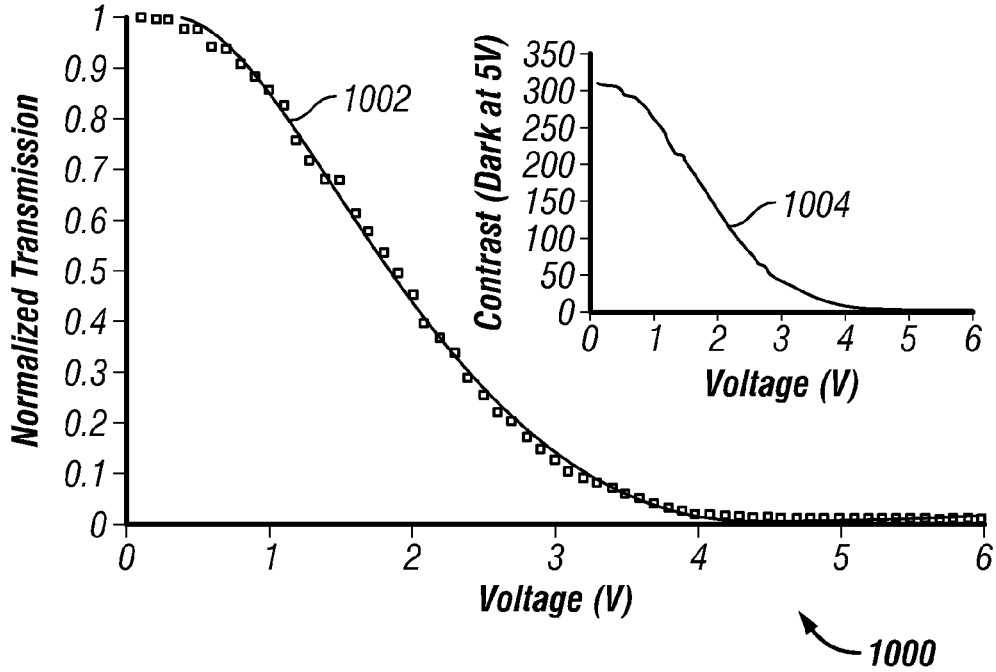
FIG. 10 shows a transmission and contrast versus voltage curve.

FIG. 10 shows an example of the transmission of SST mode of LC cell in graphical representation 1000. It shows a curve for different data voltages 1002, and more specifically it shows the effect of transmission versus voltage, and the corresponding contrast. For this SST mode, LCD has a d/P ratio between about 0.2 to 5 μm. The transmission is less than 0.31% at a driving voltage of 5V. Therefore, the maximum contrast 1004 of SST mode can be about 300. The contrast ratio can be improved further with careful optimization of the material and other design parameters. A contrast of 1000:1 is deemed sufficient for television applications. The duration and timing of the pulsed backlight unit is also an important factor in determining the ultimate contrast ratio achievable. From FIG. 10, it can be determined that optical performance of SST mode is fully compatible with TFT drivers.

Figure 11:
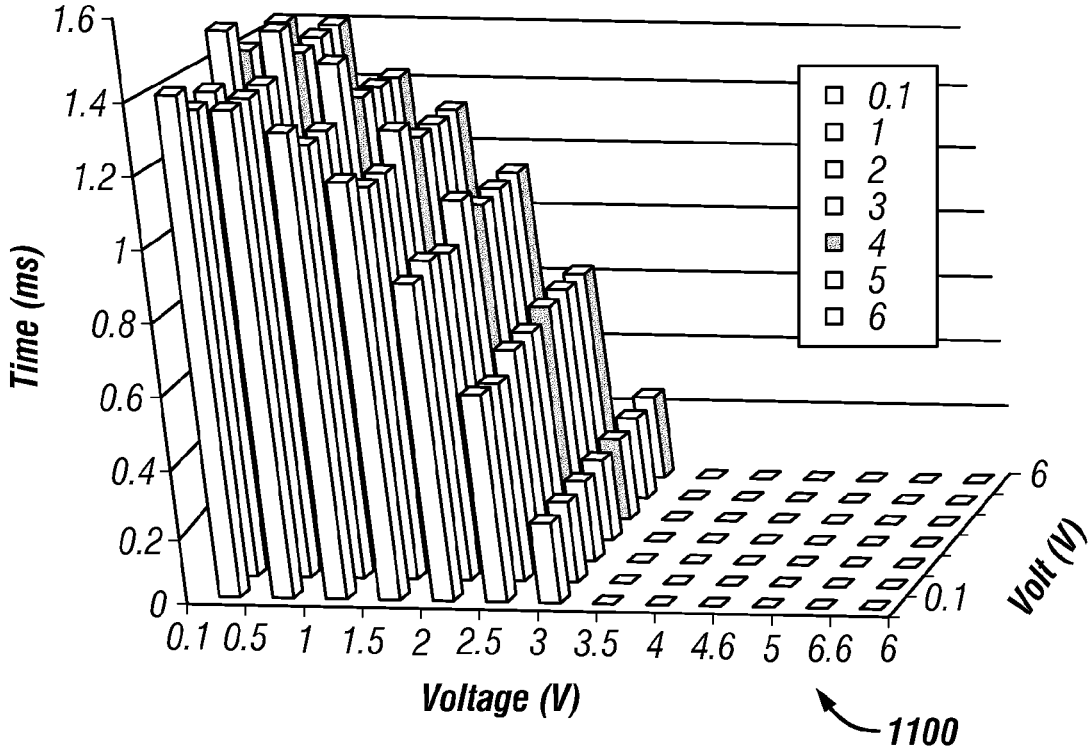
FIG. 11 shows gray-gray optical response time.

FIG. 11 shows the gray-gray optical response time. In graph 1100, it can be observed that liquid crystal molecular response time is different from the optical response time. Some display modes can be the same, for example, ECB and the TN mode. In present innovations, the optical response time can be improved, while LC molecules response time may still be long. By defining the duration and time of the pulsed backlight unit, an "equivalent gray level" can be defined for this SST mode. It is the gray level transmittance during the transient time, which can be controlled by the frame time.

It can be observed in FIG. 11 that due to the back flow effect, the gray-to-gray (GTG) response time is much faster than the LC molecular response time. FIG. 11 shows the GTG optical response for a 5 μm cell gap with a 0.2 d/P ratio SST mode of LCD. Due to a particular driving method of the present display, the GTG is measured indirectly in a sense that a brief dark state always exists between the gray levels. Therefore, the response time depends on the final gray level, and not on the initial state of LCD. In FIG. 11 the maximum measured response time is less than 1.5 ms, and the average response time is less than 1 ms. For dark states, the response time is quite short since the LC is in the dark state by applying the high voltage pulse. Using such a fast switching LC display, field sequential color can be achieved.

The following explains the details of embodiments of the present innovations regarding the driving method to achieve a full color display. This new LCD mode can be driven in both active matrix and in passive matrix mode, both in conjunction with a pulsed light source if color filters are provided In the LCD cell itself, as in conventional LCD, the pulsed light source can be only white light, and the present innovations will improve the response time and image blur of the display. There will be no motion blur. If there is no color filter provided on the LCD itself, then a pulsed light source capable of providing red, green or blue primary colors can be used. In this case, a field sequential color (FSC) technique can be used to achieve a full color display. The display frame is divided into three subframes for the three primary colors. When a subframe is scanned onto the display, the corresponding color backlight is pulsed. When this is done in fast time sequence, color integration occurs, and the observer observes and perceives a full color effect.

In a preferred embodiment of the present innovations, LCD is driven in an active matrix manner. The LCD construction is the same as shown in FIG. 100 (*a*, *b*, and *c*), and the following describes driving technique. FIG. 6, FIG. 7, and FIG. 8 show examples of driving waveform of SST mode display in an active matrix mode. To isolate the cross-talk between subframes, a dark frame (DF) is inserted before the data frame. The DF can induce a stronger back flow and optical bounce of LC such that a higher transmission can be achieved. Additionally, DF insertion can improve the contrast of the image.

Generally, GTG response time is always different for different gray levels. For example, if the display is at gray levels G2 or G3, the response time of G2 to G1 is different from that of G3 to G1. The difference of GTG response time will affect the timing of the dynamic response and the timing of the pulsed light source. This can affect the brightness of G1 and produce a false color-mixing scheme in FSC. In fact, G1 can have a different gray level.

In another embodiment of the present innovations, a gray level, called G0 can be introduced. All gray levels are first reset to G0, then the display is switched to various desired gray levels from G0 so that only G0→G1, G0→G2 or G0→G3. This will ensure that the relaxation time is consistent for any gray level. The DF serves as G0, after DF is applied, the data frame follows, which can be a green frame→GF, red frame→RF or blue frame→BF. This sequence can control the gray scale of the pixel. By repeating such a sequence (DF→GF→DF→RF→DF→BF), all red, green, and blue frames can be generated.

In another preferred embodiment, a white subframe is provided. Instead of three, LCD can also be driven with four subframes. The purpose of a white frame (WF) is to increase the brightness of the display. For WF, the LCD is scanned with the subframe, which is the same as the original data frame, and a white light is pulsed. This can be achieved by turning on all three primary colors. Thus the driving sequence can be DF→GF→DF→RF→DF→BF→DF→WF. The sequence of red, green, blue, and white can be immaterial. It can be blue, red, white, green or any combination thereof.

In preferred embodiments, the duration of DF and the duration and timing of the pulsed backlight unit can be adjusted to optimize the quality of the display. The DF can be as long as the frame time, or as short as the minimum row addressing time such as 200 μs. The frame time $T_f$ is equal to the duration of DF plus the duration of the data frame. If the DF is shorter, then the data frame can be longer. Generally, a longer data frame is desirable because the pulsed backlight can be on for a longer time and therefore, the image can be brighter.

Figure 12:
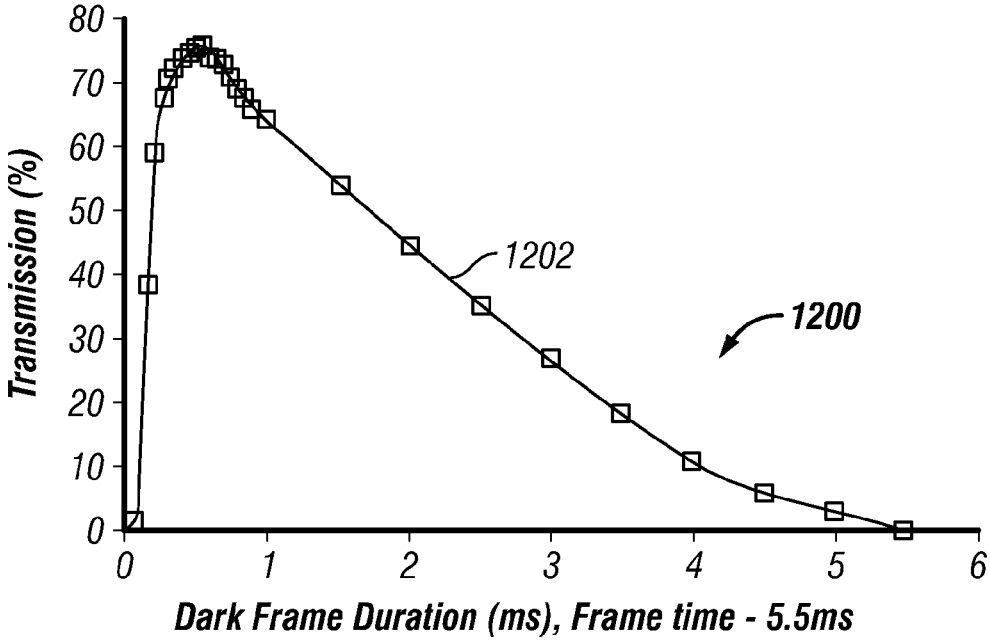
FIG. 12 shows transmission at different dark frame durations.

FIG. 12 shows a graph 1200, with transmissions 1202 at different DF durations. It is an example of results of the driving method. During a DF, 10V is applied, and the frame time $T_f$ is fixed at 5.5 ms. The transmission of the cell changes as the duration of the DF $T_{DK}$ is varied. It can be observed that the transmission increases initially as the $T_{DK}$ increases because of a strong optical bounce induced by the DF. Maximum transmission is obtained for $T_{DK}$ equal to 650 μs. However, as the duration gets longer, the frame time becomes shorter, and as a result the brightness of the display drops. This decrease is linearly proportional to the data frame time ($T_f$−$T_{DK}$).

Figure 13:
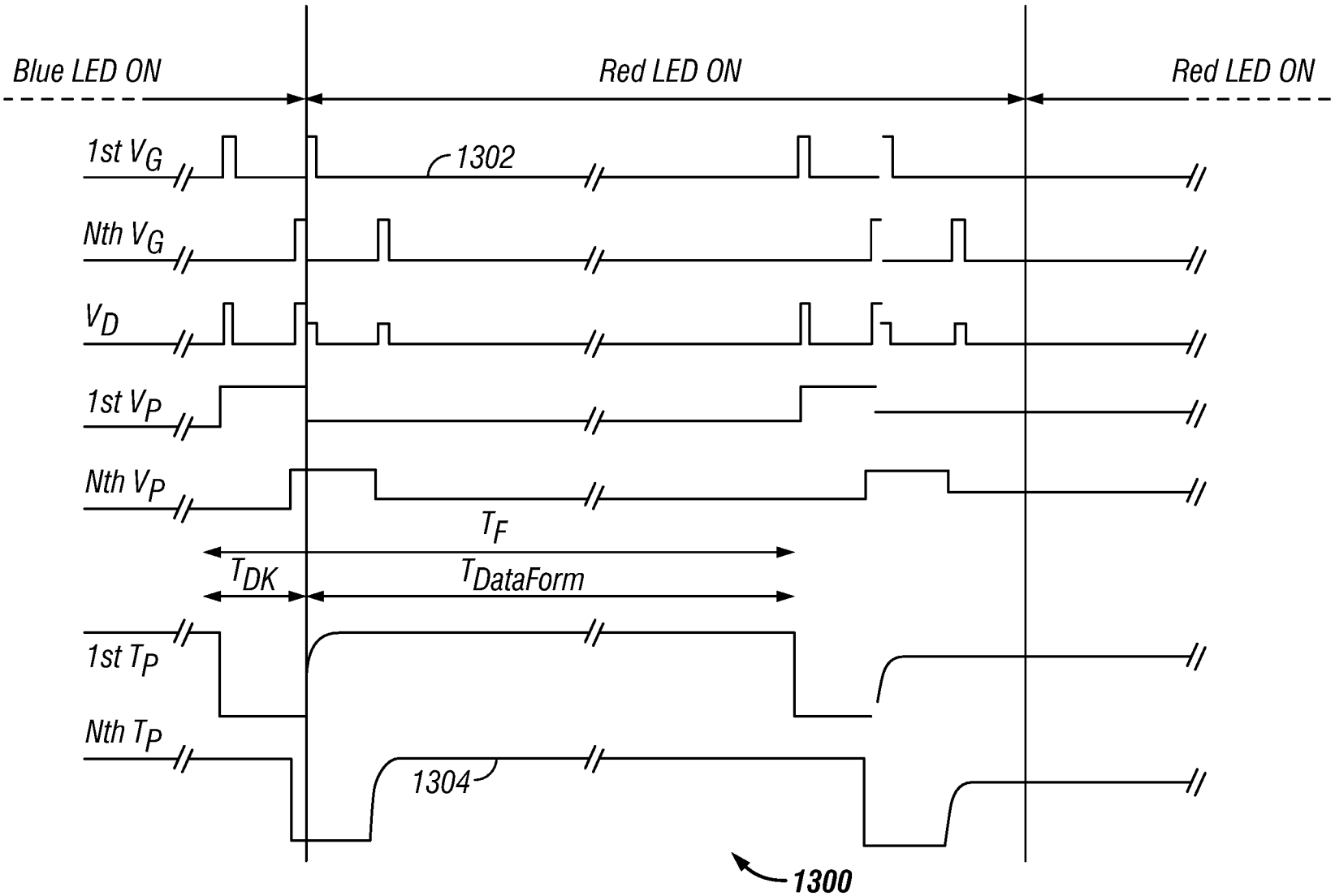
FIG. 13 shows a time diagram for the active matrix driving mode.

FIG. 13 shows a timing diagram 1300 of an active matrix field sequential color (FSC) for an LCD, which includes the first row 1302 and the last row 1304, red, green, and blue subframes. For each subframe there are two gate pulses and two data pulses. The first gate pulse and the first data pulse, which is always high gives a high voltage to turn the LCD into the dark state of the (DF). The second gate pulse and the second data pulse provides a voltage that will control the optical bounce and hence the transmission of the LCD during that subframe. The pulsed light source is labeled as LED, because LED can be used and is turned on for the entire subframe.

It can be observed that first row and the last row, even though having a time delay will provide the same optical brightness, since the LED is on constantly. The voltage pulse duration and the pulsewidth depend on time allocated to the DF. For example, for a VGA display with 480 rows refreshed at 80 Hz frame rate and 240 Hz subframe rate, the subframe time is 4.2 ms. If the DF is allowed to be 1 ms (thus leaving 3.2 ms for the LED), the pulsewidth of the scan pulse will be 2.1 μs. The time between the two gate pulses for each subframe is 1 ms (the DF). Since, the response time is about 1.2 ms, the effective LED duty cycle is 50%, and very fast scanning electronics or scanning schemes are needed for this FSC display.

Figure 14:
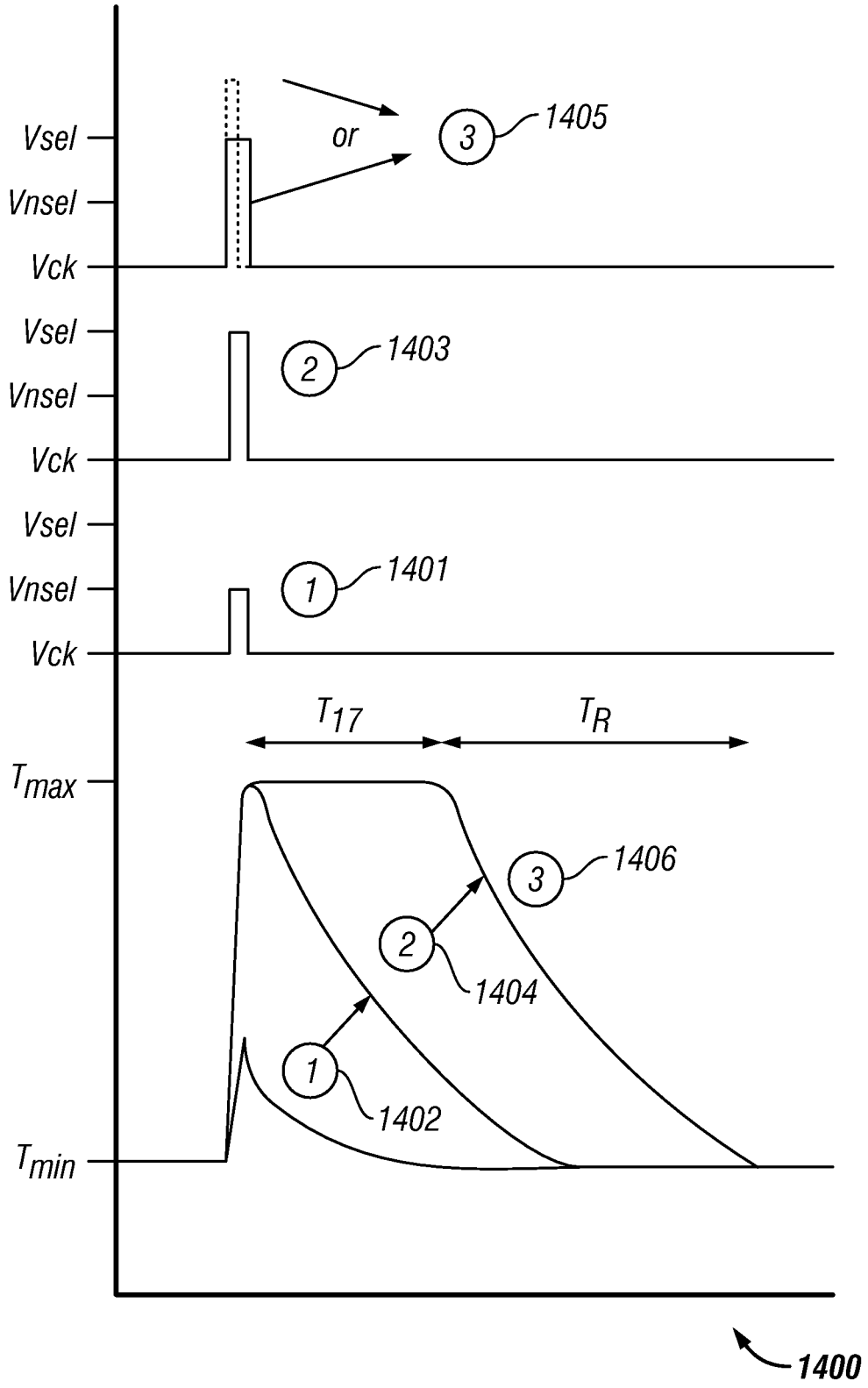
FIG. 14 shows the saturation effect using the passive matrix driving mode.

FIG. 14 shows another embodiment of the present innovations as illustrated in graph 1400, wherein LCD is driven in a passive matrix mode. It shows the concept of passively driving a fast display. Now, the configuration and the details of FIG. 14 are explained. The display should be in a normal dark state. Construction and design parameters of a specific example of this passively multiplexed fast LCD are listed in Table II.

TABLE II

Example of a LCD cell parameters for a preferred embodiment.

| | |
|---|---|
| Twist angle | 90 degree right-handed twist |
| Doping | left-handed twist |
| d/P ratio | 0.27 |
| Cell gap | 3 microns |
| Input polarizer | Parallel to input director (rubbing direction) of first substrate |
| Output polarizer | Parallel to the input polarizer |

As illustrated in graph 1400, wherein LCD is driven in a passive matrix mode. In a passive matrix mode display, the optical bounce effect is not important. The important feature is that LCD should be very fast, so that the transmission of the LCD decays back to zero within the frame time. Also the decays time should be controlled by driving voltage. 1401 shows the non-selected driving pulse with amplitude $V_{nsel}$, the corresponding optical response of the LCD is 1402. The relaxing time is very short or even can be ignored. When higher voltage is applied 1403, i.e. $V_{sel}$, the LC molecule will response dramatically 1404. The relaxing time or called transient time of the LCD is much longer. If the driving duration is long enough 1405, the hysteresis effect $T_H$ will occur before the relaxing time $T_R$ 1406.

As described in the prior art, the voltage level in a multiplex drive with N scan lines is adjustable from $V_{nsel}=V_s-V_d$ to $V_{sel}=V_s+V_d$, where $V_s$ is the scan voltage and $V_d$ is the data voltage. For conventional passive matrix mode, the Alt and Pleshko law applies and the ratio of voltages is given by $V_s/V_d=\sqrt{N}$. Since the present innovations do not depend on time averaging, which is the basis of the Alt and Pleshko law, any value for $V_d$ and $V_s$ can be chosen. However, the pulse train is still a typical multiplex drive comprising; a first high voltage pulse (either $V_s-V_d$ or $V_s+V_d$), followed by cross-talk pulsed at $\pm V_d$. The gray level can be controlled by the magnitude or pulse width of $V_d$.

Figure 15:
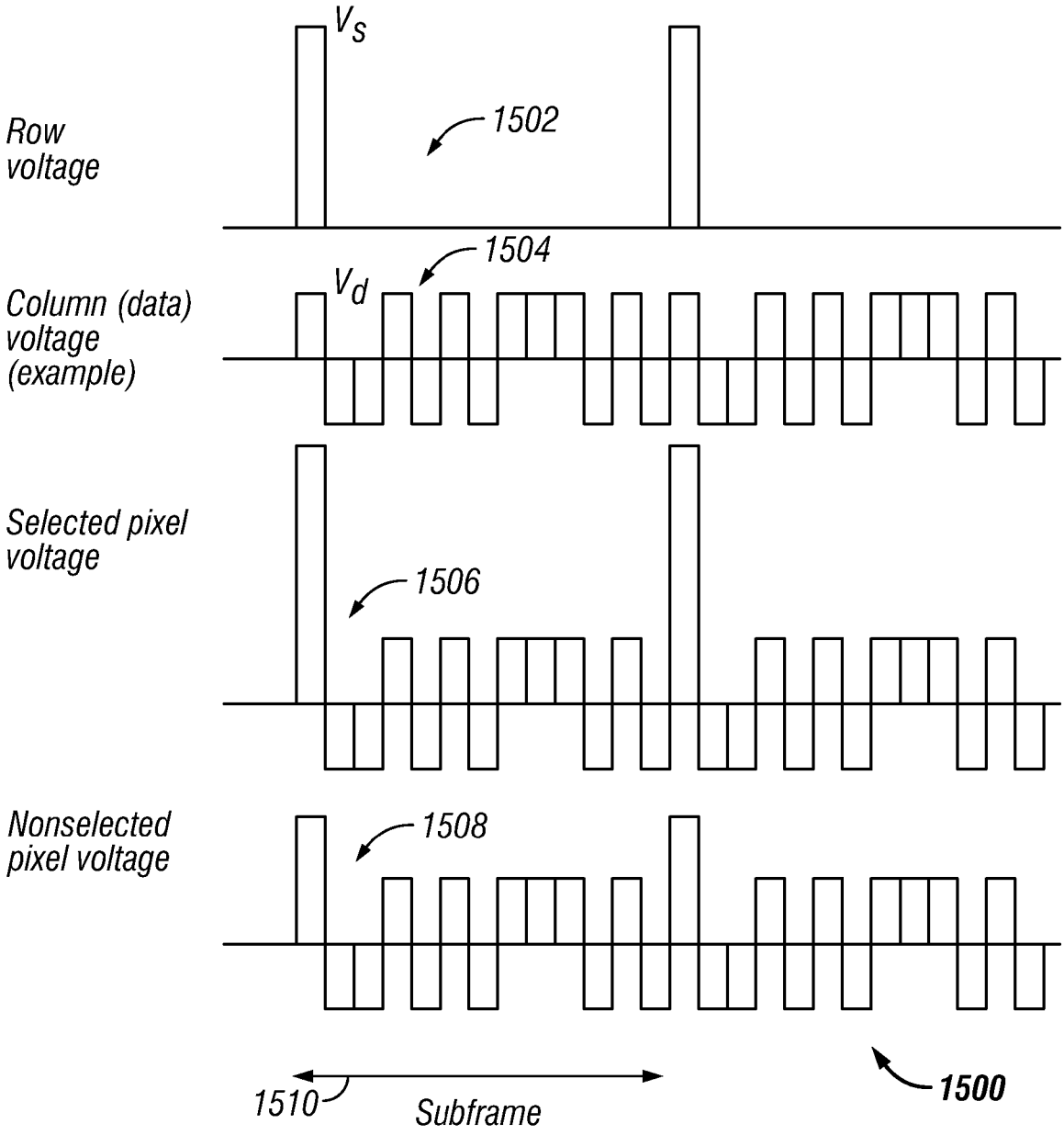
FIG. 15 shows the conventional passive matrix driving mode.

FIG. 15 shows a graph 1500 for conventional passive matrix driving mode. The illustration shows the row voltage 1502, column voltage 1504, selected pixel voltage 1506, non-selected pixel voltage 1508, and the subframe 1510. The voltage pulse train on the pixel is shown in the upper trace of FIG. 15. This is a standard multiplexing driving (V. G. Chigrinov, Liquid Crystal Devices, Artech House, Boston 1999). The scanning is line-by-line with a voltage pulse value $V_s$ for the addressed row. The data signal includes M slots, with a voltage of $-V_d$ for the selected pixel and $+V_d$ for the non-selected pixel. The row voltage and the data voltage pulse trains are applied to opposite electrodes of opposite substrates of LCD respectively. Therefore, the pixel voltage is the difference between these voltages. This is the passive matrix driving arrangement.

As shown in FIG. 15 the selected pixel will have a pulse train, which includes a high voltage pulse at $V_s+V_d$, with voltage of $\pm V_d$ for the rest of the frame. The non-selected pixel will have the same pulse train except that the high voltage pulse is now $V_s-V_d$. There is a major difference between this invention and the standard multiplexing. It is the relationship between the select voltage $V_{sel}$ and nonselect voltage $V_{nsel}$. In conventional multiplex driving scheme, $V_{sel}$ and $V_{nsel}$ are average voltages related to the selection ratio from the Alt and Pleshko law due to time averaging. However, without relying on time averaging, and using the instantaneous transmission of the LC cell, select and non-selected voltages can be freely chosen. For example, equate $V_{sel}=V_s+V_d$ and $V_{nsel}=V_s-V_d$. The requirement is that $V_{nsel}$ should be below the Frederick transition voltage of LCD.

Referring again to FIG. 15, three curves from the top are examples of multiplex driving pulse trains with cross-talk pulses at $\pm V_d$ omitted for simplicity, and only first driving high voltage pulse is shown. The bottom part of FIG. 15 shows a composite of three curves, which are the transmission of LCD under these three driving conditions. When the driving pulse is high or a long duration, the transmission is driven high into saturation. When the driving pulse is reduced in voltage or duration, the transmission is reduced, because of the saturation effect. It can be observed in FIG. 15 the shapes for time dependence of the transmission curves are different. In this embodiment, difference to produce multiplex driving of the display is used. If the pulsed backlight is turned on during the frame when the transmission of the LCD is changing, the brightness of the display will change according to the pixel voltage level.

Figure 16:
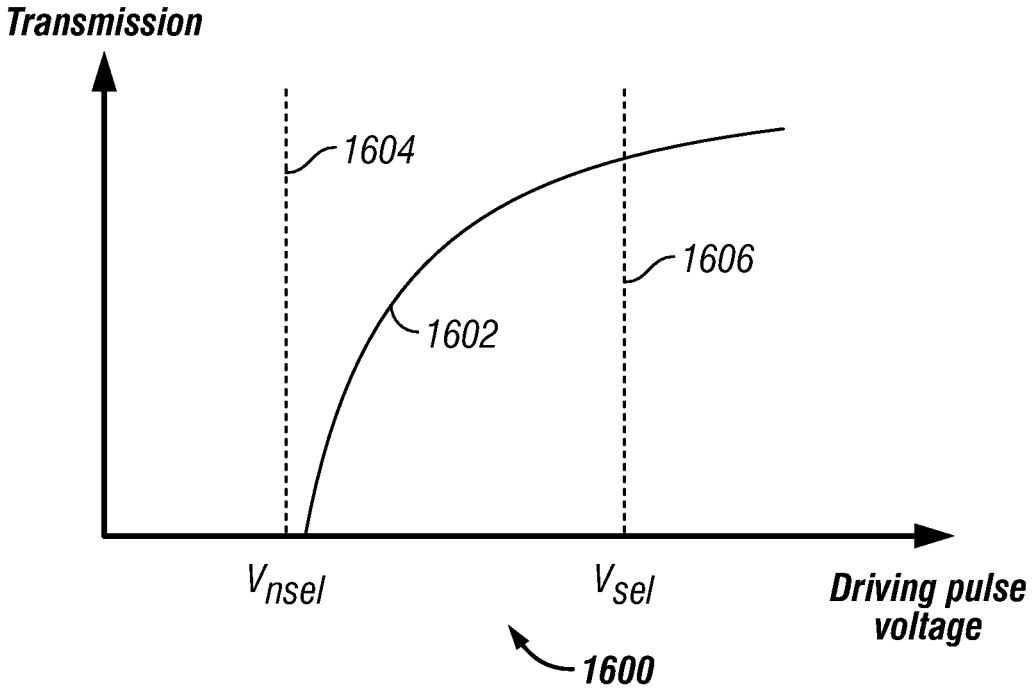
FIG. 16 shows transmission versus different high voltage driving curves.

FIG. 16 shows a graph 1600 for the transmission curve 1602, non-select voltage 1604, and the select voltage 1604 of LCD as a function of first high voltage pulse in the pulse train when the pulsed backlight duration is fixed. If the timing of the pulsed light is close to the high voltage pulse, the maximum transmittance of the LCD can be optimized by varying the values of $V_s$, $V_d$ and the pulse duration. If $V_s-V_d$ is set below the threshold of LC deformation, this state can correspond to the dark state if parallel polarizers are used. Any voltage higher than this will induce a transmission as shown in FIG. 14. At $V_s+V_d$, the transmission of the LCD can saturate with a time delay of $T_d$, where the transmission cannot be increased further. A good contrast ratio can be achieved since the dark state is truly dark (below threshold). The brightness of the display will be optimal if the pulsed light backlight is turned on at $T_d$, just after saturation of the transmission.

In multiplex driving of the present invention, cross-talk is small provided; (1) $V_s-V_d$ times the pulse width is below the Frederick transition threshold; (2) The transmission recovers to zero during the frame time; and (3) $V_s+V_d$ is large enough to induce a transmission saturation effect. It is also noted that the normal limitation of a selection ratio for a passive matrix mode supertwist LCD (STN) does not apply in this case, because the instantaneous transmission of the LCD is used for the time-averaged transmission.

For example, the 1/32 duty display is examined. At 60 Hz frame rate, with three red, green, and blue subframes, the subframe time is 5.5 ms, and the pulse duration is 0.17 ms. It is found that a scan voltage $V_s$ and a data voltages $V_d$ of 11V and 7V work well.

Figure 17:
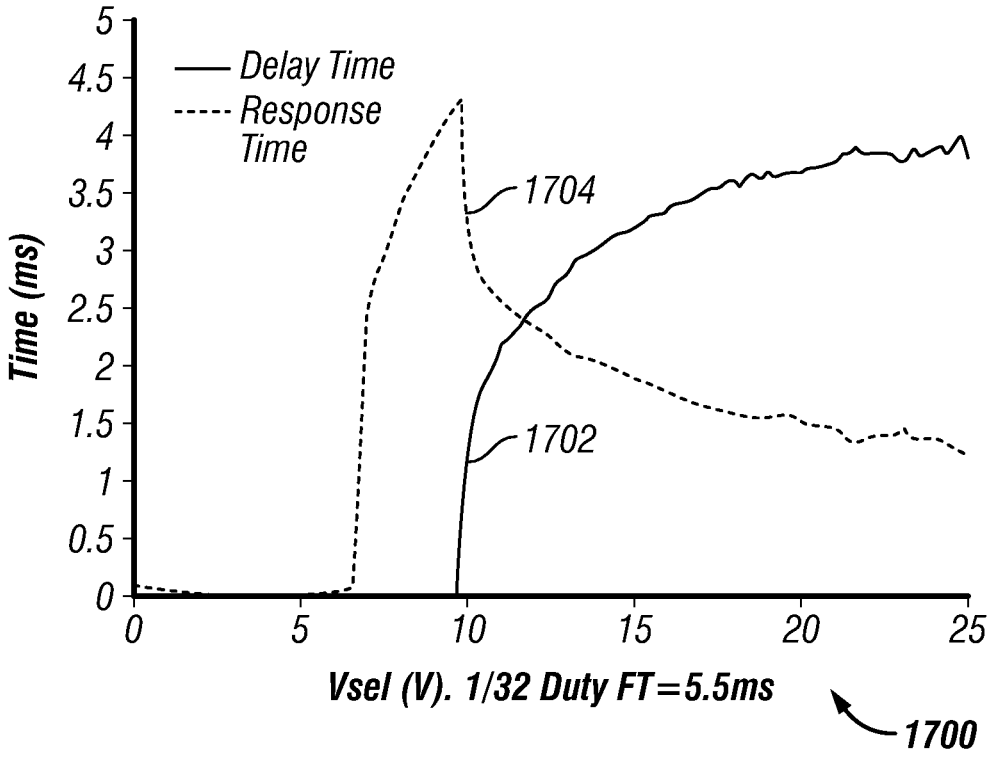
FIG. 17 shows the delay and response time for different select voltages.

FIG. 17 shows the delay time and response time graph 1700 as the function of selected voltage. Adjusting the proper select voltage amplitude or duration (i.e., either amplitude or pulse width modulations), the time delay can be up to 3 ms. By making use of such phenomenon, passive matrix driving for field sequential color display can be possible.

The data presented in FIG. 17 corresponds to an example of a 1/32 duty passive matrix mode display. The delay time 1702, and response time 1704 are shown in FIG. 17. The cell-gap is 3 μm, and the d/P ratio is 0.27, and the driving pulse width is 174 μs. The root mean square voltage of cross-talk is 2 volt. It can be found that if the select voltage is operated at 11V, the non-select voltage can be about 7V. Such a configuration will induce 2.15 ms memory time (solid line), and the response time for non-select voltage is about 2.5 ms. Therefore, both operations can be finished within 1 frame time (5.5 ms).

Figure 18:
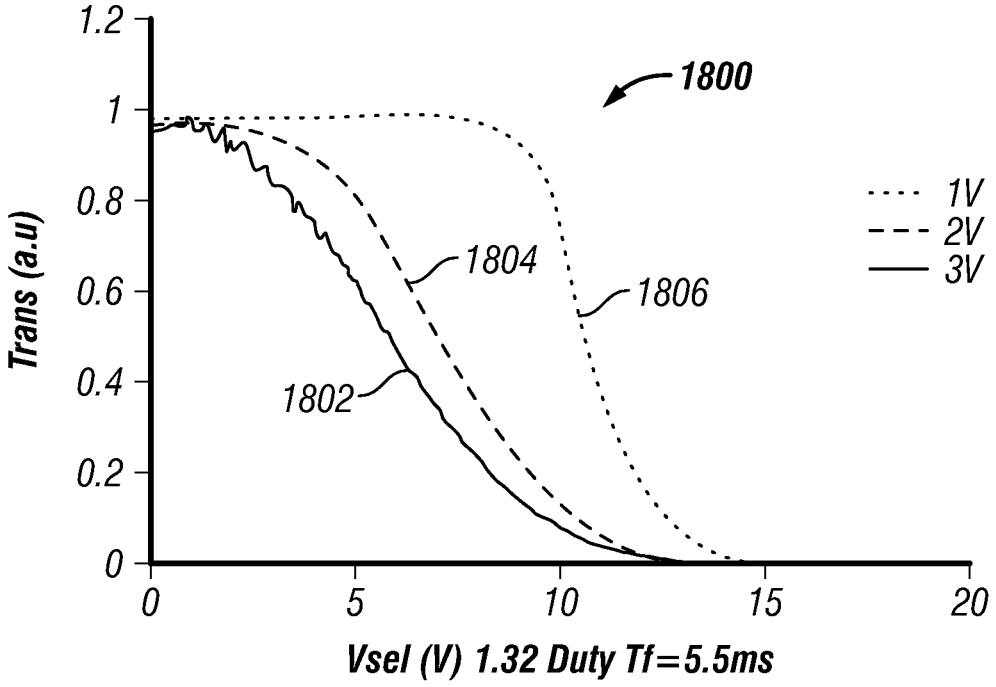
FIG. 18 shows a transmission versus voltage curve under various cross-talk conditions.

FIG. 18 shows the transmission versus selection voltage curves 1800. The absolute value of the transmittance depends on the timing of pulsed light source. The solid line 1802 is for $V_d=3V_{rms}$, dash line 1804 is for $V_d=2V_{rms}$ and the dotted line 1806 is $V_d=1V_{rms}$, and these voltages represent cross-talk, which is caused from the data voltage $V_d$. The maximum contrast is about 35 with $2V_{rms}$ cross-talk. The contrast is the ratio of transmission for bright state to dark state. For bright state, pixel will be applied driving voltage at $V_d(N-1)/N+(V_s+V_d)/N$ while $V_d(N-1)/N+(V_s-V_d)/N$ for dark state. Contrast is not the only factor for the high quality passive matrix mode field sequential display.

Referring again to FIG. 18 it can be observed that high contrast can induce poor transmission in a non-select state. Therefore, the brightness can be impacted. From experimental results, it is can be observed that the contrast at range of 15 is the optimum.

Figure 19:
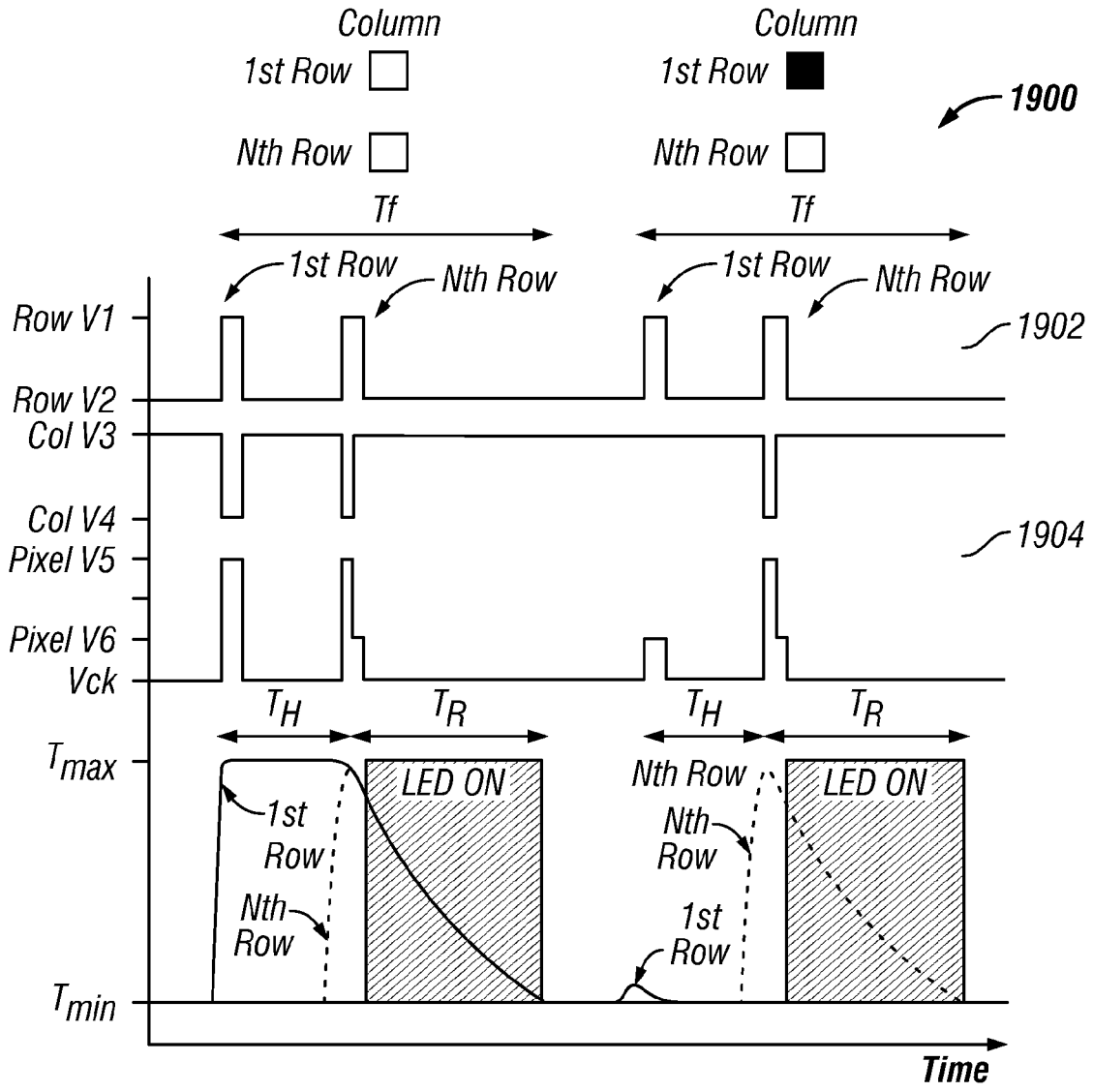
FIG. 19 shows a timing diagram for the passive matrix driving mode.

FIG. 19 shows schematically the various voltage pulses 1900 for the multiplex driving of the fast LCD. In this illustration, an LED is used as the pulsed backlight source. Different color LED can be used corresponding to the primary colors to achieve full color display without any color filters. The timing of the pixel voltage and the pulsed backlight source are depicted in FIG. 19. It can be observed that there is a time delay for the first row 1902 and the last row 1904. This will induce a brightness change and will have to be compensated. The following describes a method to compensate for this change.

The subframe time $T_f$ of field sequential passive matrix display is quite short and is typically less than 6 ms. The time delay of the scanning from top to bottom may cause a change in brightness of the particular pixels, and should be compensated. The row scan time $T_s$ is typically about 100 μs to 150 μs. Therefore, the time left for the LC molecule to respond is $T_f-T_s$ for the first row 1902, and $T_f-NT_s$ for the last row 1904, where N is the number of rows. Different relaxation times induce different average brightness. This causes the brightness at first row 1902 to be different from the Nth row. For compensating the difference in brightness, a reverse scan frame (RSF) method is used for the present innovations. In RSF technique, the scanning for one frame is from the first row 1902 to the Nth row, while the following frame will be scanned from the Nth row to the first row. This way the brightness variations can be compensated.

In another embodiment of the present innovations, instead of compensating varying brightness using reverse scanning, the brightness variation can be compensated using electrical control of the brightness of the backlight, either by varying its duration or its amplitude, and this can be achieved by controlling the light source.

Figure 20:
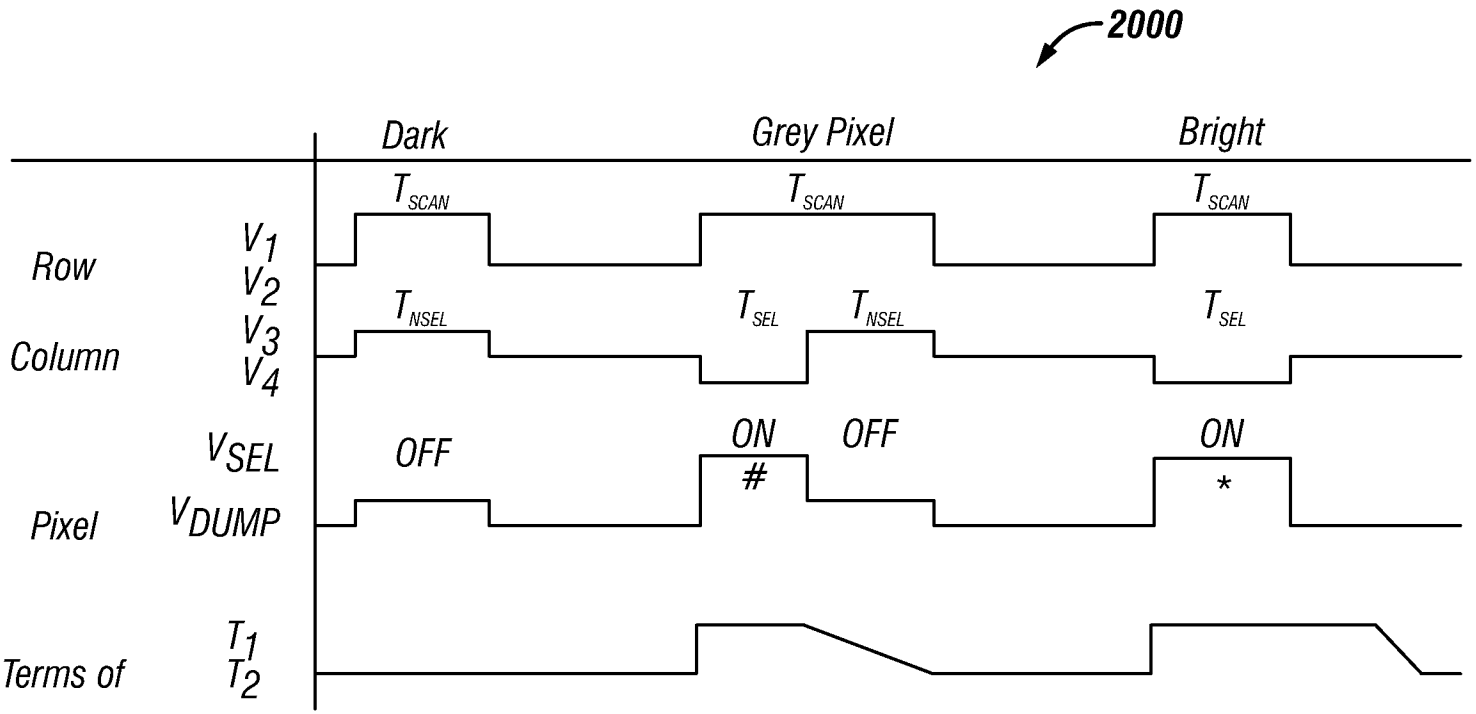
FIG. 20 shows an example of dark, gray, and bright pixel driving mode.

FIG. 20 shows another embodiment of the present innovations. The graph 2000 shows an example of dark, gray, and bright pixel driving mode method, wherein the gray levels of the passively driven display can be achieved either by pulse amplitude modulation (PAM), or by changing the voltage of $V_d$, or by pulse-width modulation (PWM). The data pulse is sub-divided into different time sections with only a portion of it being the select voltage. FIG. 20 shows the scan time compensation using PWM. To simplify the voltage level, the voltage between $V_{sel}$ to $V_{nsel}$ is called $V_{SEL}$. The voltage $V_{DUMP}$ is corresponding to either $V_6$ or $V_7$. In case 2, gray is applied to Pixel selected pulse "#". The LC molecule will respond immediately after the selected pulse. Such equivalent voltage is about 8V according to FIG. 17. In case 3, bright, over driving is applied, and such pixel waveform can be found in FIG. 20 with symbol "*". $T_H$ is moderated according to row number and also the grey scale required. After all the rows are scanned, the LED flashed and completed the subframe finally.

Figure 21:
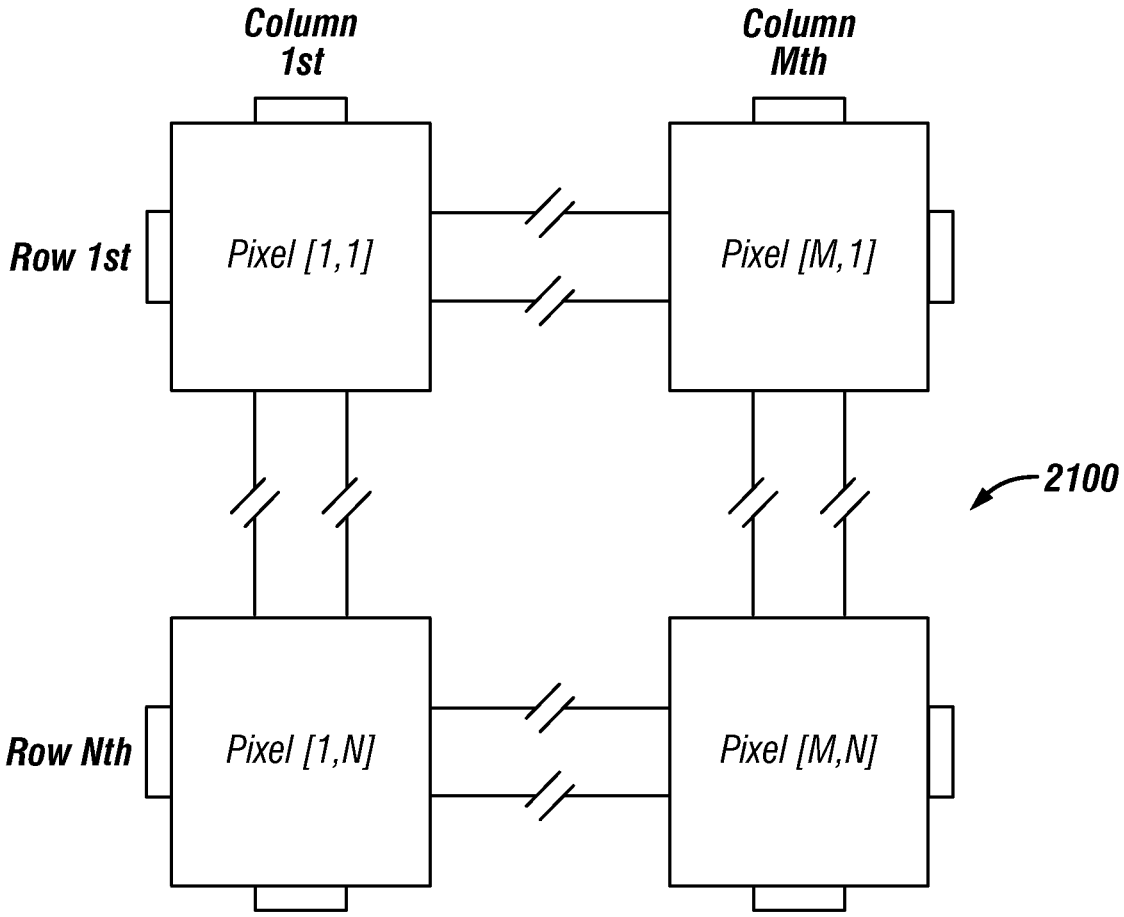
FIG. 21 shows an example of pixel arrangement on the passive matrix mode LCD.

FIG. 21 shows an example of pixel arrangement on the passive matrix mode LCD. It illustrates a layout of the N by M pixel arrangement as shown in block diagram 2100. Four pixels are selected to show different color, such as [1,1]→Red, [1,N]→Green, [M,1]→Black, and [M,N]→Blue.

Figure 22:
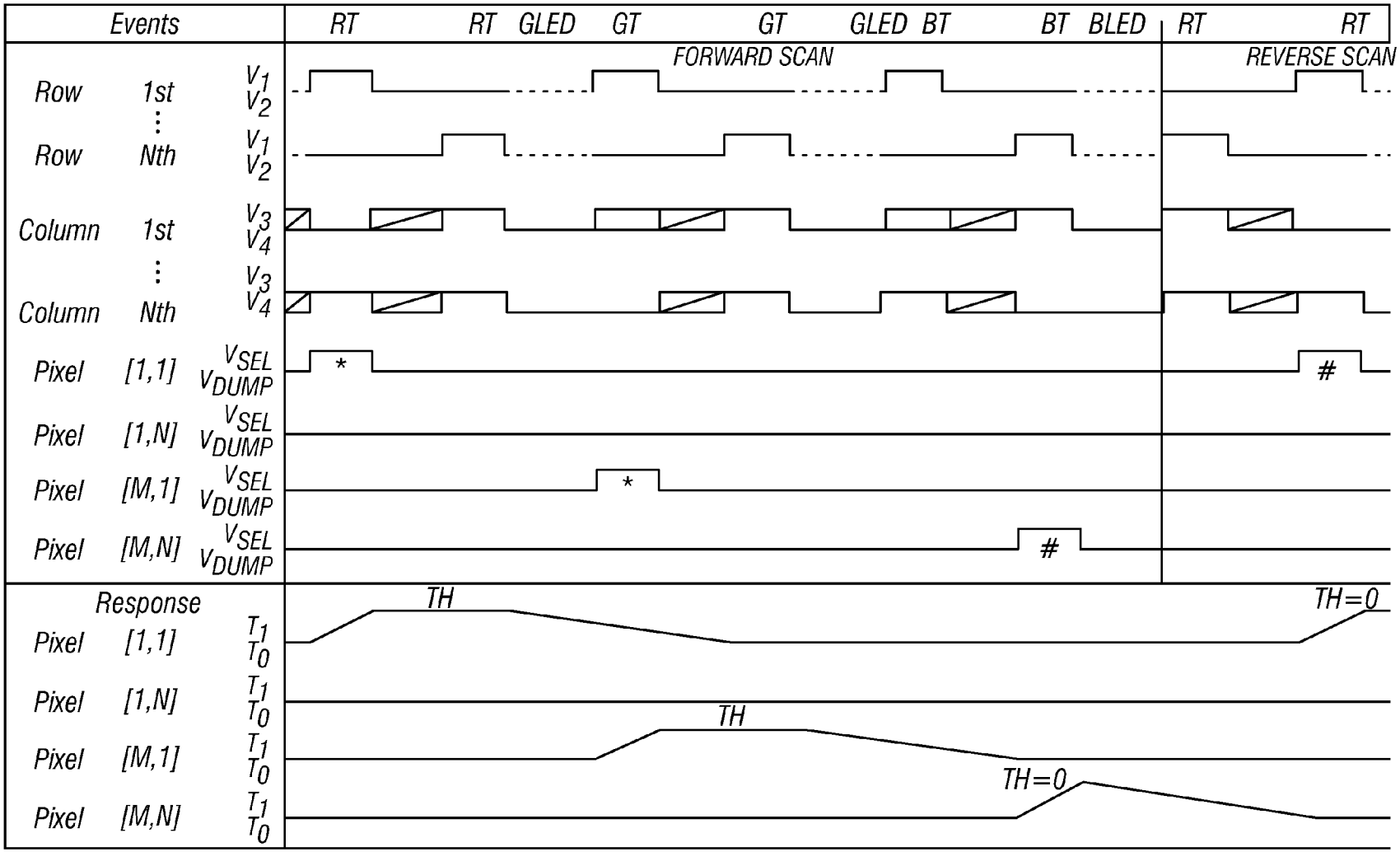
FIG. 22 shows a detailed passive matrix mode driving time diagram.

FIG. 22 shows a detailed passive matrix mode driving scheme diagram 2200, for showing the corresponding pixel's colors in FIG. 21. The frame time $T_f$ includes the scan time $T_S$, and LED on time, $T_{LED}$. The full frame time is the sub-frame time of Red $T_{fr}$, Green $T_{fg}$ and Blue $T_{fb}$. Therefore, within each sub-frame, $T_{fr}$, only those pixels for red will be selected and the rest will remain in the non-select state. Furthermore, delay effect must be applied in order to preserve the brightness uniformity. The selected pixels at different rows exhibit different optical responses. The time delay $T_H$ must be optimized to compensate for the scan time difference between the rows. According to FIG. 20, this corresponds to $V_1$=11V, $V_2$=2V for row scan, $V_3$=4V and $V_4$=0V for the column data voltage.

Normally, the voltages have the following arrangement $|V_1|>|V_3|>|V_2|>|V_4|$. The non-selected pixel $V_{nsel}$ will experience $|V_1|-|V_3|$=7V. The selected pixel voltage $V_{sel}$ is $|V_2|-|V_4|$=11V. According to FIG. 19, a 2.15 ms delay will be induced by $V_{sel}$, 1/32 duty pulse, while the LC will not respond when $V_{nsel}$ is applied. Using PWM or PAM, the select voltage $V_{sel}$ can be adjusted from $V_{nsel}$ to $V_{sel}$ arbitrarily. It can be applied to control the gray scale and scan time compensation.

To further improve the brightness uniformity, on top of traditional passive matrix driving method, such as APT, MLA, FLC-MLA, PWM-MLA, and AMLA, a reverse scan frame RSF is introduced. If the first color frame scan from 1st to Nth row, the next corresponding color frame will be scanning from Nth row to 1st row. The scanning sequence will be, RF→GF→BF→RSF_RF→RSF_GF→RSF_BF.

MODIFICATIONS AND VARIATIONS

As will be recognized by those skilled in the art, the innovative concepts described in the present application can be modified and varied over a tremendous range of applications, and accordingly the scope of patented subject matter is not limited by any of the specific exemplary teachings given. It is intended to embrace all such alternatives, modifications and variations that fall within the spirit and broad scope of the appended claims.

Additional general background, which helps to show variations and implementations, may be found in the following publications, all of which are hereby incorporated by reference:

None of the description in the present application should be read as implying that any particular element, step, or function is an essential element which must be included in the claim scope: THE SCOPE OF PATENTED SUBJECT MATTER IS DEFINED ONLY BY THE ALLOWED CLAIMS. Moreover, none of these claims are intended to invoke paragraph six of 35 USC section 112 unless the exact words "means for" are followed by a participle.

The claims as filed are intended to be as comprehensive as possible, and NO subject matter is intentionally relinquished, dedicated, or abandoned.

What is claimed is:

1. A method for displaying on a liquid crystal display, comprising:

using transient states of a liquid crystal material to represent rapidly changing transmission of a display;

using substrates and alignment layers to align said liquid crystal material;

selecting one of said transient states; and transiently lighting said liquid crystal material with pulsed backlight at moments when said liquid crystal material is in the one of said transient states.

2. The method of claim 1, wherein the using the substrates includes using at least one substrate of glass material.

3. The method of claim 1, wherein the using the substrates includes using at least one substrate of indium tin oxide material.

4. The method of claim 1, wherein the using the alignment layers includes using polyamide material for at least one of the alignment layers.

5. The method of claim 1, wherein a direction of the alignment layers is a same or substantially same direction as at least one direction of the substrates.

6. The method of claim 1, wherein the using the transient states of the liquid crystal material is based on a division of the liquid crystal material into a plurality of pixels.

7. The method of claim 6, further comprising:

using color filters for the plurality of pixels.

8. The method of claim 1, wherein the transiently lighting includes using white light as the pulsed backlight.

9. The method of claim 1, wherein the transiently lighting includes using at least one of red light, green light, or blue light as the pulsed backlight.

10. The method of claim 6, wherein the using the transient states includes driving the liquid crystal material in an active matrix mode.

11. The method of claim 10, wherein the using the transient states of the liquid crystal material in the active matrix mode includes driving at least one pixel of the plurality of pixels with at least one transistor to control at least one voltage of the at least one pixel.

12. The method of claim 6, wherein the using the transient states includes using the transient states of the liquid crystal material in a passive matrix mode.

13. The method of claim 10, further comprising:

inserting a dark frame between data frames for at least a subset of the plurality of pixels.

14. The method of claim 1, wherein the using the transient states includes using the transient states of the liquid crystal material in an optical rebound mode.

15. The method of claim 1, wherein the using the transient states includes using the transient states of the liquid crystal material in a rebound mode, wherein the rebound mode facilitates the using of the transient states without change in an applied drive signal.

16. The method of claim 1, wherein the using the transient states includes using the transient states of the liquid crystal material in a relaxation mode intermediate between steady states.

17. A liquid crystal device, comprising:

liquid crystal material aligned between physical orientation layers that define an orientation for said liquid crystal material, with a first chirality;

said liquid crystal material including a chiral dopant that biases said liquid crystal material toward a second chirality, opposite to said first chirality;

said liquid crystal material having both twist and splay deformations;

a plurality of respective electrodes, individually positioned in proximity to respective portions of said liquid crystal material in particular respective pixel locations;

a pulsed light that transiently illuminates said liquid crystal material in at least one selected transient state of a plurality of transient states of the liquid crystal material; and a polarization filter that overlies said liquid crystal material to selectively pass or block light in dependence on an orientation state of said liquid crystal material.

18. The liquid crystal device in claim 17, further comprising a patterned array of connections that apply electromagnetic fields to change orientations of said liquid crystal material in the particular respective pixel locations.

19. The liquid crystal device in claim 18, further comprising a rear polarization filter that underlies the liquid crystal material.

20. The liquid crystal device of claim 18, wherein the pulsed light transiently illuminates said liquid crystal material in the at least one selected transient state of the liquid crystal material, to increase contrast, and reduce power of display operations of the liquid crystal device relative to the pulsed light being absent.

21. A display, comprising:

liquid crystal material aligned between physical orientation layers that define an orientation for said liquid crystal material with a first chirality;

wherein said liquid crystal material includes a chiral dopant that biases said material toward a second chirality, opposite to said first chirality, and wherein said liquid crystal material has both twist and splay deformation; and backlights that illuminate said liquid crystal material transiently in flashes, said flashes having a minimum duration less than a predefined duration used for a video on the display to facilitate a reduction of smears at moving object boundaries when the video is displayed.

22. The display of claim 21, wherein said display is a full color display.

23. The display of claim 21, wherein said display is an active matrix mode display.

24. The display of claim 21, wherein said display is a passive matrix mode display.

25. The display of claim 21, wherein said display is configurable according to a non-display mode.

26. The display of claim 25, wherein said non-display mode is employed in a printer.

* * * * *